US012690672B2

(12) United States Patent
Chen

(10) Patent No.: US 12,690,672 B2
(45) Date of Patent: Jul. 28, 2026

(54) ADJUSTABLE LIFT COMBINED TYPE SHELF

(71) Applicant: Protrend Co., Ltd., Taipei City (TW)

(72) Inventor: Shun-Yi Chen, Taipei City (TW)

(73) Assignee: PROTREND CO., LTD., Taipei City (TW)

( * ) Notice: Subject to any disclaimer, the term of this patent is extended or adjusted under 35 U.S.C. 154(b) by 0 days.

(21) Appl. No.: 19/059,333

(22) Filed: Feb. 21, 2025

(65) Prior Publication Data

US 2026/0191325 A1 Jul. 9, 2026

(30) Foreign Application Priority Data

Jan. 6, 2025 (TW) ..... 114100466

(51) Int. Cl.

| | |
|---|---|
| ***A47B 57/50*** | (2006.01) |
| ***A47B 57/06*** | (2006.01) |
| ***A47B 96/14*** | (2006.01) |
| *A47B 47/00* | (2006.01) |
| *A47B 57/08* | (2006.01) |
| *A47B 57/30* | (2006.01) |
| *A47B 57/32* | (2006.01) |

(52) U.S. Cl.

CPC ..... *A47B 57/50* (2013.01); *A47B 57/06* (2013.01); *A47B 96/1408* (2013.01); *A47B 47/0083* (2013.01); *A47B 57/08* (2013.01); *A47B 57/30* (2013.01); *A47B 57/32* (2013.01)

(58) Field of Classification Search

CPC ..... A47B 57/50; A47B 96/1408; A47B 57/06; A47B 57/08; A47B 57/10; A47B 57/20; A47B 57/30; A47B 57/32; A47B 57/34; A47B 57/48; A47B 47/00; A47B 47/0083; A47B 47/021; A47B 47/027; A47B 47/045

See application file for complete search history.

(56) References Cited

U.S. PATENT DOCUMENTS 4,852,501 A * 8/1989 Olson ..... A47B 57/265 108/107
5,924,581 A * 7/1999 Chen ..... A47B 57/265 211/187
6,302,284 B1 * 10/2001 Zonshin ..... A47B 47/0083 108/147.11

(Continued)

*Primary Examiner* — Devin K Barnett
(74) *Attorney, Agent, or Firm* — WPAT, PC

(57) ABSTRACT

An adjustable lift combined type shelf is provided. The adjustable lift combined type shelf includes a plurality of post components, several assembly fixtures, multiple fastening holes, and several storage layers. The post components include tubes and holes. The assembly fixtures have assembly columns that are installed into the holes of the post components, allowing the assembly fixtures to be mounted on the upper and lower ends of the column assemblies. The storage layers include movable shelves and four sleeve components, each positioned at the four corners of the movable shelf. Each sleeve component is equipped with an assembly element, and the size of the sleeve components is larger than the size of the tubes. The storage layers move along the assembly direction, and the protruding columns snap into the ends of the fastening holes, thereby assembling the storage layers between the column assemblies.

10 Claims, 20 Drawing Sheets

(56) References Cited

U.S. PATENT DOCUMENTS 6,357,611 B1 * 3/2002 Chen ..... A47B 57/26 211/187
6,364,138 B1 * 4/2002 Chen ..... A47B 57/26 211/187
6,422,407 B2 * 7/2002 Arai ..... A47B 45/00 211/175
7,992,730 B2 * 8/2011 Huang ..... A47B 57/265 211/187
8,118,181 B2 * 2/2012 Shinozaki ..... A47B 47/0083 211/208
8,651,300 B2 * 2/2014 Chen ..... A47B 47/024 211/187
8,678,207 B2 * 3/2014 Shimazaki ..... A47B 57/545 211/208
9,192,250 B2 * 11/2015 Maurer ..... A47B 47/0083
11,700,940 B1 * 7/2023 Chen ..... F16B 2/245 211/187
11,805,897 B1 * 11/2023 Chen ..... A47B 87/001
2003/0131767 A1 * 7/2003 Chen ..... A47B 57/265 108/147.13
2004/0065633 A1 * 4/2004 Chen ..... A47F 5/13 211/175
2006/0202091 A1 * 9/2006 Oddsen ..... F16M 11/24 248/122.1
2009/0184078 A1 * 7/2009 Lee ..... A47B 57/54 211/187
2010/0089852 A1 * 4/2010 Wang ..... A47F 5/13 211/153
2010/0096352 A1 * 4/2010 Wang ..... A47B 47/045 211/187
2010/0155352 A1 * 6/2010 Hsieh ..... A47B 57/265 211/183
2015/0060380 A1 * 3/2015 Maurer ..... A47F 5/01 211/90.03
2022/0361672 A1 * 11/2022 Chen ..... A47B 47/021
2022/0378195 A1 * 12/2022 Chen ..... A47B 47/0058
2022/0378197 A1 * 12/2022 Chen ..... A47B 57/545
2024/0090661 A1 * 3/2024 Chen ..... A47B 57/22
2024/0090662 A1 * 3/2024 Chen ..... A47B 47/0083

* cited by examiner

ADJUSTABLE LIFT COMBINED TYPE SHELF

CROSS REFERENCE TO RELATED APPLICATION

This application claims the benefits of Taiwan application Serial No. 114100466, filed on Jan. 6, 2025, the disclosures of which are incorporated by references herein in its entirety.

TECHNICAL FIELD

The present disclosure relates to a shelf, and more particularly to an adjustable lift combined type shelf which can lift and lower the storage layers.

BACKGROUND

A combined type shelf is a storage shelf composed of multiple independent components (such as storage layers, connecting pieces, etc.) that can be assembled and used for storage. The design of combined type shelves usually emphasizes flexibility and scalability to meet the needs of home, office and other occasions.

Generally, the assembly structure of the storage layer and the column is relatively complicated and time-consuming to assemble. The height of the storage layer cannot be adjusted according to actual conditions. That is, the storage layer cannot be raised or lowered after being fixed to the column, which is inconvenient to use.

SUMMARY

The embodiment of the present disclosure provides an adjustable lift combined type shelf. The storage layers can be lifted and lowered, the structure is simple and relatively stable, and the convenience of use is improved.

An embodiment of the present disclosure provides an adjustable lift combined type shelf comprising a plurality of post components, a plurality of assembly fixtures, a plurality of fastening holes, and a plurality of storage layers. The post components comprise a tube and a plurality of holes respectively. Each of the post components has an upper end and a lower end opposite to the upper end, and at least one of the holes is disposed at the upper end and the lower end of each of the post components. The assembly fixtures are provided with at least one assembly column. Each of the assembly columns is installed in the corresponding hole, so as to assemble the assembly fixtures at the upper end and the lower end of each of the post components. The fastening holes have a closing end respectively. The storage layers comprise a movable shelf, four sleeve components, and four assembly elements respectively. The four sleeve components are respectively arranged at four corners of the corresponding movable shelf, each of the sleeve components is provided with the assembly element, a protruding cylinder is arranged on one side of each of the assembly elements, each of the protruding cylinders is located inside the corresponding sleeve component, a size of the four sleeve assemblies is larger than a size of the tubes, the storage layers move along an assembly direction, each of the protruding cylinders is respectively engaged within the closing end of the corresponding fastening hole to assemble the storage layers between the post components, the four sleeve components in the storage layer corresponding to the upper end and the lower end of each of the post components are respectively attached to an outer surface of the corresponding assembly fixture.

In one embodiment, along the assembly direction, a size of the fastening holes is a tapered hole structure.

In one embodiment, the fastening holes are respectively penetrated on the tube at intervals, each of the fastening holes has an opening end and the closing end opposite to each other, a size of each of the opening end is larger than a size of the corresponding closing end, and a size of each of the protruding cylinders is smaller than a size of the opening end of the corresponding fastening hole.

In one embodiment, a cross section of each of the closing ends is a curved structure, and a cross section of each of the opening ends is a rectangular structure with an opening.

In one embodiment, a cross section of each of the opening ends is a curved structure, and a cross section of each of the closing ends is a rectangular structure with an opening.

In one embodiment, each of the sleeve components is a square sleeve, each of the tubes is a square tube structure respectively, each of the tubes comprises a first plate, a second plate, a third plate, and an assembly plate, each of the first plates, the corresponding second plates, the corresponding third plates and the corresponding assembly plates are connected to form the square tube three-dimensional structure, the first plate and the corresponding second plate are on opposite sides, the assembly plate and the corresponding third plate are on opposite sides, the fastening holes are penetrated at different positions of the assembly plate, and two of the holes are penetrated respectively in the third plate.

In one embodiment, each of the assembly fixtures comprises a bottom plate, a first side plate, a second side plate, and an assembly column, two sides of each of the bottom plates are respectively vertically connected to the corresponding first side plate and the second side plate, each of the first side plate and the corresponding second side plate are opposite sides, the assembly column is arranged and protrudes from an inner surface of the corresponding bottom plate, each of the first side plates is attached to the corresponding first plate, each of the second side plates is attached to the corresponding second plate, and each of the bottom plates is attached to the corresponding third plate.

In one embodiment, the assembly plate of each of the tubes is provided with a plurality of inclined plates, each of the inclined plates is connected to the opening end of the corresponding fastening hole, and each of the inclined plates is formed by bending the opening end of the corresponding fastening hole.

In one embodiment, each of the tubes is a circular tube structure respectively, each of the sleeve components is a circular sleeve, and along the assembly direction, a size of the fastening holes is a tapered hole structure, and one of the fastening holes is arranged at the corresponding assembly fixture.

In one embodiment, each of the sleeve components comprises two semicircular components that are engaged with each other.

Based on the foregoing, in the adjustable lift combined type shelf of the present disclosure, the assembly structure is simple and relatively stable. In addition, the storage layer can move along the lifting direction on the post component, thereby improving the overall convenience of use.

In addition, the assembly fixtures are respectively arranged at the upper end and lower end of the post component. Accordingly, the protruding cylinder in the sleeve component is fastened outside the fastening hole, and the assembly fixtures are located in the accommodating portion inside the sleeve component, so as to enhance the stability of the storage layer arranged on the post component.

In addition, the size of the assembly component in the storage layer of the present disclosure is larger than the size of the tube of the post component, and thus these storage layers can be moved up and down relative to the post component along the lifting direction. Furthermore, during the moving process along the assembly direction, the storage layers can be assembled to the post component, and the assembly fixtures can be assembled at the upper end and lower end of the post component to improve the stability of the storage layers assembled to the post component.

A detailed description is given in the following embodiments with reference to the accompanying drawings, in order to make the disclosure more comprehensible.

DETAILED DESCRIPTION

Figure 1:
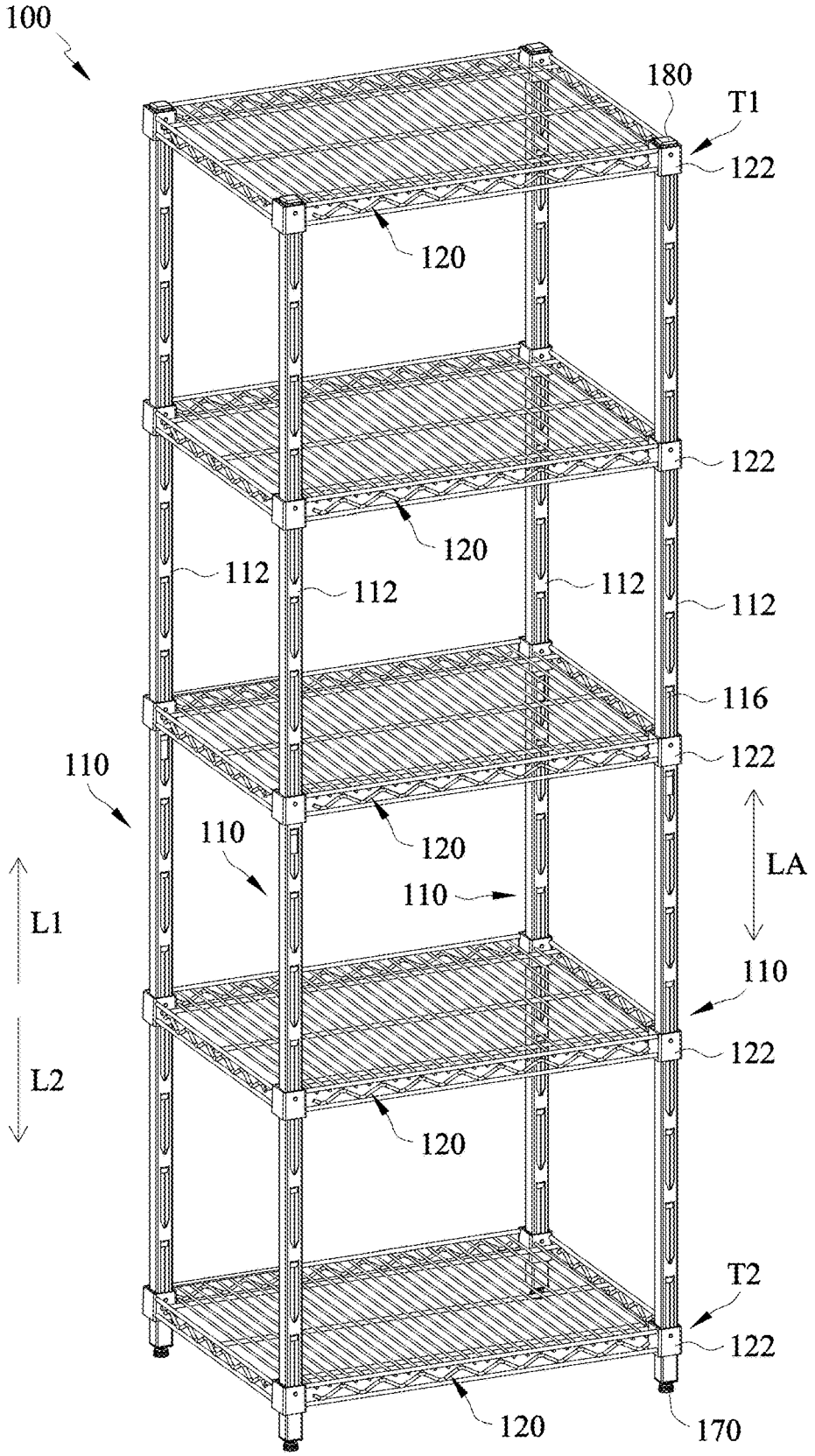
FIG. 1 is a three-dimensional schematic diagram of an embodiment of an adjustable lift combined type shelf according to the present disclosure.

The following embodiments are set forth in detail with accompanying drawings, but the embodiments provided are not intended to limit the scope of the disclosure. In addition, the drawings are for illustrative purposes only and are not drawn to original size. To facilitate understanding, the same components will be identified with the same symbols in the following description.

The terms "including", "comprising", "having", etc. mentioned in the disclosure are open terms, which means "including but not limited to".

In the description of each embodiment, when describing the elements by the terms "first," "second," "third," "fourth," and the like, it is used only to distinguish these components from one another and does not limit the order or importance of these components.

In the description of each embodiment, the so-called "component" may refer to a single part or element constituting a larger system, device or structure. These components can be independent or can collaborate with other components to complete specific functions. Components have different specific meanings in different fields, but generally refer to a basic unit that makes up the whole.

In the description of each embodiment, the so-called "square tube" refers to a tube with a square cross-section.

In the description of each embodiment, the so-called "circular tube" refers to a tube with a circular cross-section.

In the description of each embodiment, the so-called "hollow tube" refers to a circular or other shaped tubular structure having a cavity inside and a certain thickness outside. Hollow tubes are different from solid tubes in that the inside of hollow tubes is empty, which can reduce weight, save materials and provide higher space efficiency.

In the description of each embodiment, the so-called "recessed portion" refers to a region or a local portion of a surface that is lower in depth than other surrounding portions and is concave or sunken.

In the description of each embodiment, the so-called "tapered hole structure" refers to a hole in an object or structure having a shape that gradually becomes smaller or shrinks. Unlike ordinary holes with a constant diameter, the diameter of a tapered hole gradually decreases as the depth or length changes. In other words, the hole size (diameter)

of a tapered hole gradually decreases from one end to the other. Typically, the hole is larger on one end and smaller on the other end.

In the description of each embodiment, the so-called "sleeve" refers to a sleeve with a specific shape, which enables it to fit closely with other components to provide stable connection and support.

In the description of each embodiment, the so-called "hollow structure" refers to a structure having an internal cavity or void. This hollow structure is usually surrounded by an external boundary and forms a hollow area on the inside.

In the description of each embodiment, the so-called "stacking direction" refers to the way or order in which objects are stacked and arranged, and usually refers to the relative position and arrangement direction of objects in space.

In the description of each embodiment, the so-called "assembly direction" refers to the direction in which components, parts or elements are connected or arranged in a certain way or sequence during the assembly process, and describes how to assemble each part at a specific angle, position or sequence.

In the description of each embodiment, the so-called "lifting direction" refers to the movement in the vertical direction, which corresponds to the movement in the horizontal direction, such as the moving direction of an object along the vertical axis, including the upward (rising) or downward (falling) motion of an object.

FIG. 1 is a three-dimensional schematic diagram of an embodiment of an adjustable lift combined type shelf according to the present disclosure. Please refer to FIG. 1, the adjustable lift combined type shelf 100 of the present disclosure includes multiple post components 110 and five storage layers 120. Each storage layer 120 has sleeve components 122 at four corners. FIG. 1 shows a total of four post components 110. The two post components 110 at the front are spaced apart by a distance, the two post components 110 at the rear are also spaced apart by a distance, and the two post components 110 at the front and rear are also spaced apart by a distance. These post components 110 are arranged in a rectangular shape or an arbitrary shape. The five storage layers 120 are sequentially located between the post components 110 along the stacking direction L1. In addition, the storage layers 120 have a structural configuration that can move along the lifting direction LA and can be assembled between the post components 110 by the sleeve assembly 122. Therefore, the storage layers 120 have a structural configuration that can move along the lifting direction LA, and the height position of the storage layers 120 can be adjusted according to the size of the stored objects to improve the convenience of use. The number of storage layers 120 can be adjusted according to actual needs, and thus a variety of different combinations of the adjustable lift combined type shelves 100 can be formed.

Figure 2A:
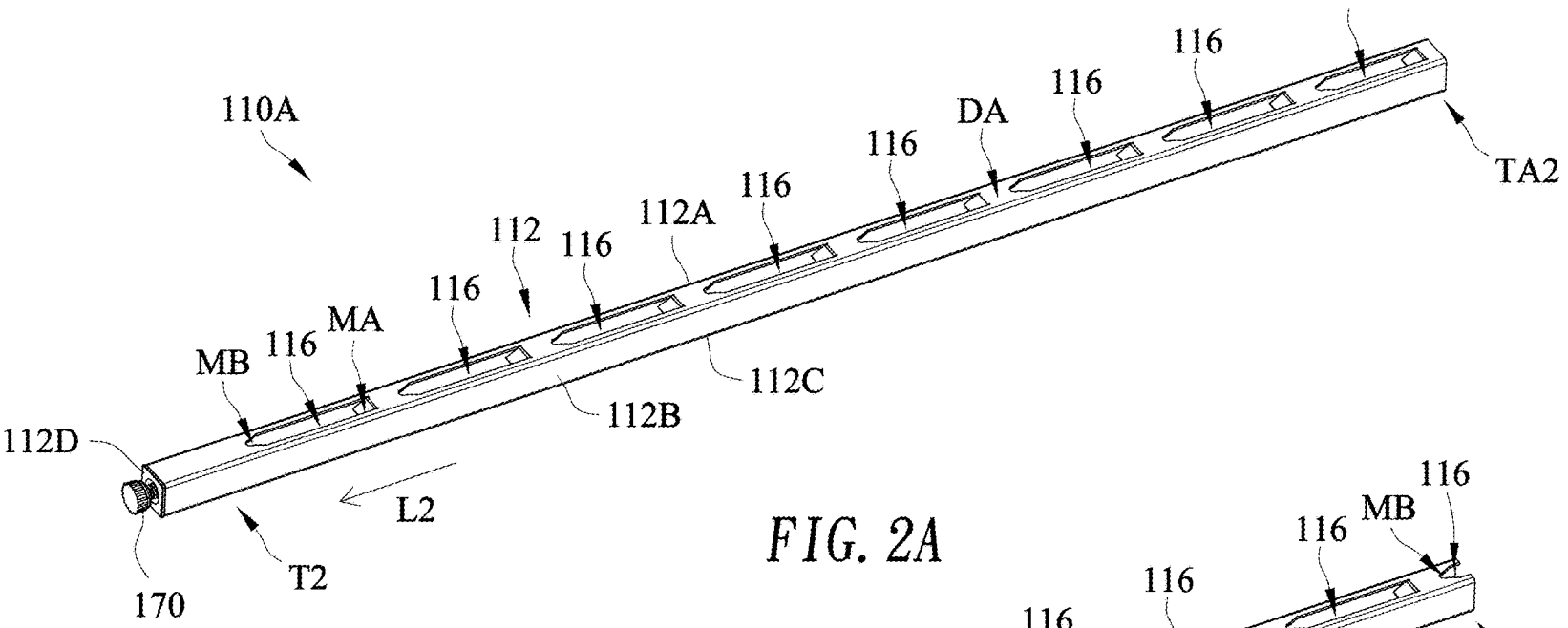
FIG. 2A is a three-dimensional schematic diagram of a first type of post component according to the present disclosure.
Figure 2B:
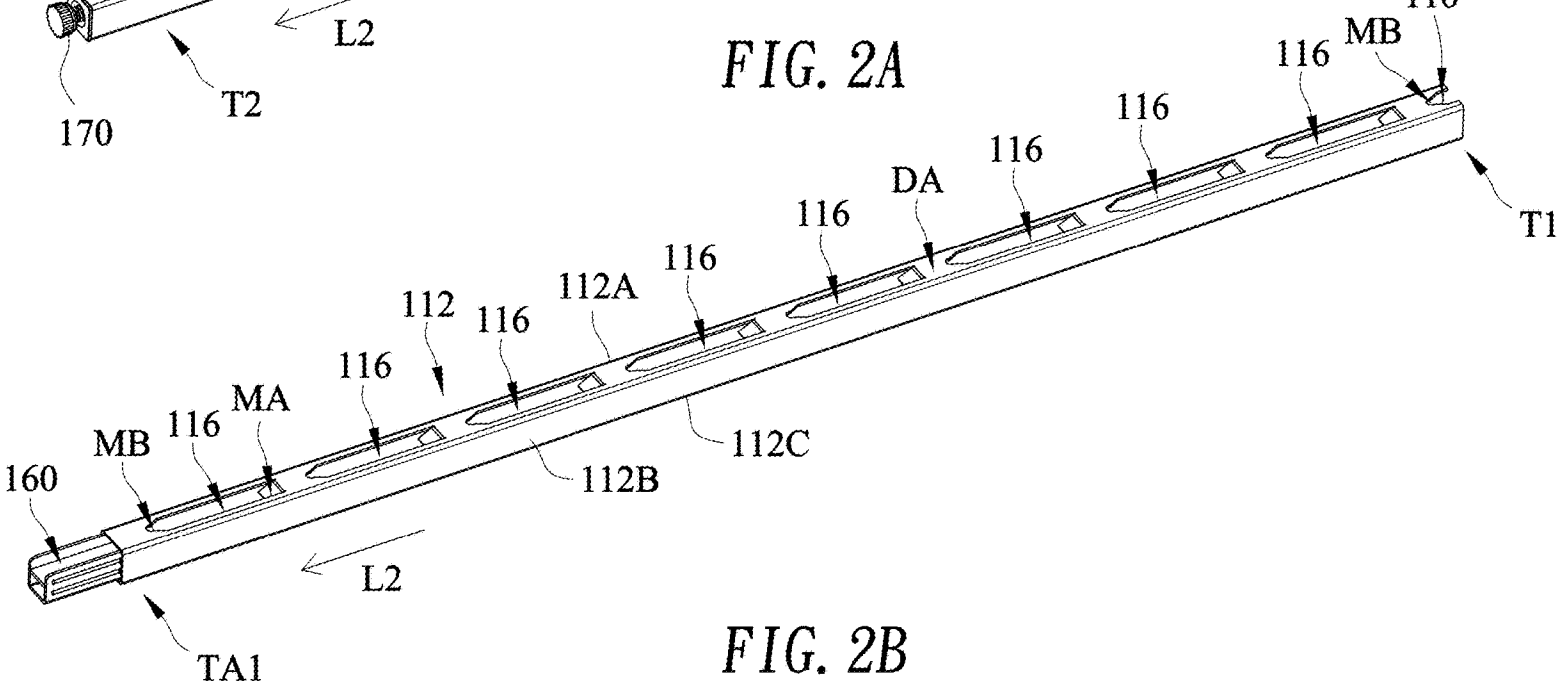
FIG. 2B is a three-dimensional schematic diagram of a second type of post component according to the present disclosure.
Figure 3:
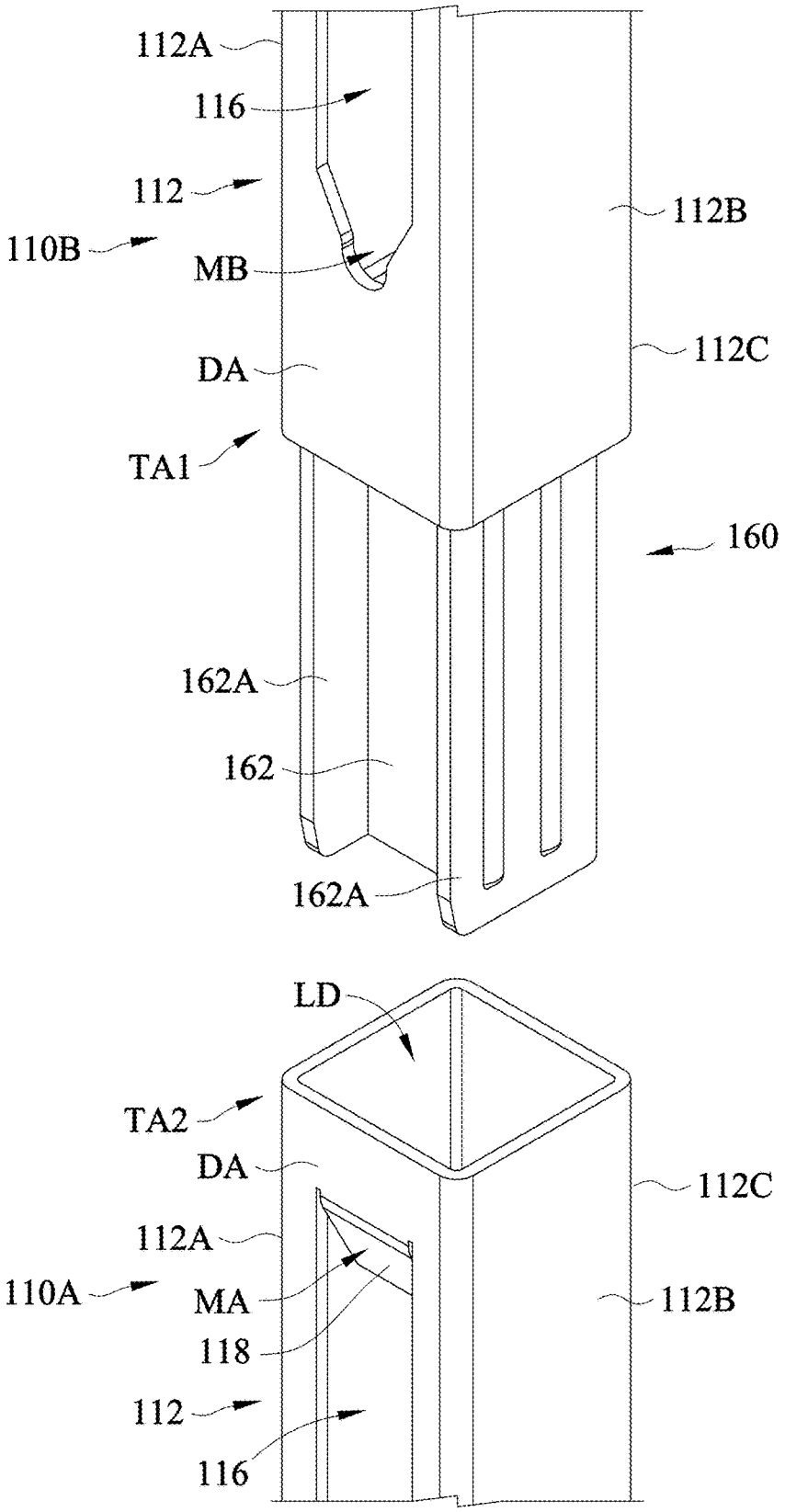
FIG. 3 is a three-dimensional schematic diagram of the assembly process of the first type of post component and the second type of post component according to the present disclosure.

FIG. 2A is a three-dimensional schematic diagram of a first type of post component according to the present disclosure. FIG. 2B is a three-dimensional schematic diagram of a second type of post component according to the present disclosure. FIG. 3 is a three-dimensional schematic diagram of the assembly process of the first type of post component and the second type of post component according to the present disclosure. Please refer to FIGS. 1 to 3. The post component 110 of the present disclosure has a predetermined length. The length of the post component 110 can be adjusted according to the actual required height of the adjustable lift combined type shelf 100. The post component 110 can also reach a predetermined length through assembly manners.

Taking FIG. 1, FIG. 2A and FIG. 2B as examples. The post component 110 has an upper end T1 and a lower end T2 opposite to the upper end T1. The post component 110 can be divided into a first type of post component 110A as shown in FIG. 2A and a second type of post component 110B as shown in FIG. 2B. The bottom 112D of the first type of post component 110A is provided with a foot post 170. The foot post 170 is used to increase the stability of the overall adjustable lift combined type shelf 100 as shown in FIG. 1. The first type of post component 110A has a lower end T2 and an assembly end TA2, and the lower end T2 and the assembly end TA1 are opposite ends.

The second type of post component 110B has an upper end T1 and an assembly end TA1, and the upper end T1 and the assembly end TA2 are opposite ends. The second type of post component 110B is provided with a connecting piece 160, and the position of the connecting piece 160 is adjacent to the assembly end TAL. The assembly end TA1 of the second type of post component 110B faces the assembly end TA2 of the first type of post component 110A. The connecting piece 160 of the second type of post component 110B is assembled in the first type of post component 110A, so as to increase the height of the entire post component 110 as shown in FIG. 1.

Specifically, the first type of post component 110A and the second type of post component 110B in the post components 110 respectively include a tube 112 and a plurality of fastening holes 116. The fastening holes 116 are respectively penetrated in the tube 112 at intervals, and the fastening holes 116 are along the length direction of the tube 112. The length direction is parallel to an assembly direction L2 (the assembly direction L2 is opposite to the stacking direction L1 as shown in FIG. 1). The fastening holes 116 have an opening end MA and a closing end MB opposite to each other, and the size of the opening end MA is larger than the size of the closing end MB. In one embodiment, the cross section of the closing end MB is a curved structure, and the cross section of the opening end MA is a rectangular structure with an opening.

In one embodiment, along the assembly direction L2, the size of the fastening hole 116 from the opening end MA to the closing end MB gradually decreases. That is, the size of the fastening hole 116 along the assembly direction L2 is a tapered hole structure.

The tube 112 may be a square tube structure comprising a first plate 112A, a second plate 112B, a third plate 112C, and an assembly plate DA. The first plate 112A and the second plate 112B are parallel to each other, the third plate 112C and the assembly plate DA are parallel to each other. The two sides of the third plate 112C are respectively connected to the first plate 112A and the second plate 112B, and the two sides of the assembly plate DA are respectively connected to the first plate 112A and the second plate 112B. Accordingly, the first plate 112A, the second plate 112B, the third plate 112C, and the assembly plate DA are connected to form a square tube three-dimensional structure. The first plate 112A and the second plate 112B are on opposite sides, the assembly plate DA and the third plate 112C are on opposite sides. An internal space formed by the first plate 112A, the second plate 112B, the third plate 112C, and the assembly plate DA is a hollow portion LD. That is, the tube 112 has a hollow portion LD inside and is a hollow tube.

As shown in FIG. 3, the connecting piece 160 can be assembled to the hollow portion LD inside the tube 112. The hollow portion LD is the space inside the tube 112. The connecting piece 160 is inserted into the hollow portion LD. The connecting piece 160 is assembled inside the tube 112, so that the second type of post component 110B is assembled with the first type of post component 110A.

The fastening holes 116 are respectively penetrated at different positions of the assembly plate DA of the tube 112 at intervals. The structural configuration of the connecting piece 160 can be adjusted according to the structural configuration of the tube 112. For example, the assembly plate DA of the tube 112 is provided with a plurality of inclined plates 118, each inclined plate 118 is provided at one end of the fastening hole 116. As shown in FIG. 3, the inclined plate 118 is connected to the opening end MA of the fastening hole 116. The inclined plate 118 is a plate bent from the opening end MA of the fastening hole 116, and the inclined plate 118 is inclined toward the hollow portion LD inside the tube 112, so that the inclined position of the inclined plate 118 is located in the hollow portion LD. Therefore, the connecting piece 160 is a concave component 162. The protruding components 162A are disposed at both ends of the concave component 162, so that the concave component 162 is concave in shape and can avoid the setting position of the inclined plate 118. In an embodiment not shown, if the tube is not provided with an inclined plate, the connecting piece can be adjusted to a non-concave component according to the structural configuration of the tube.

Figure 4A:
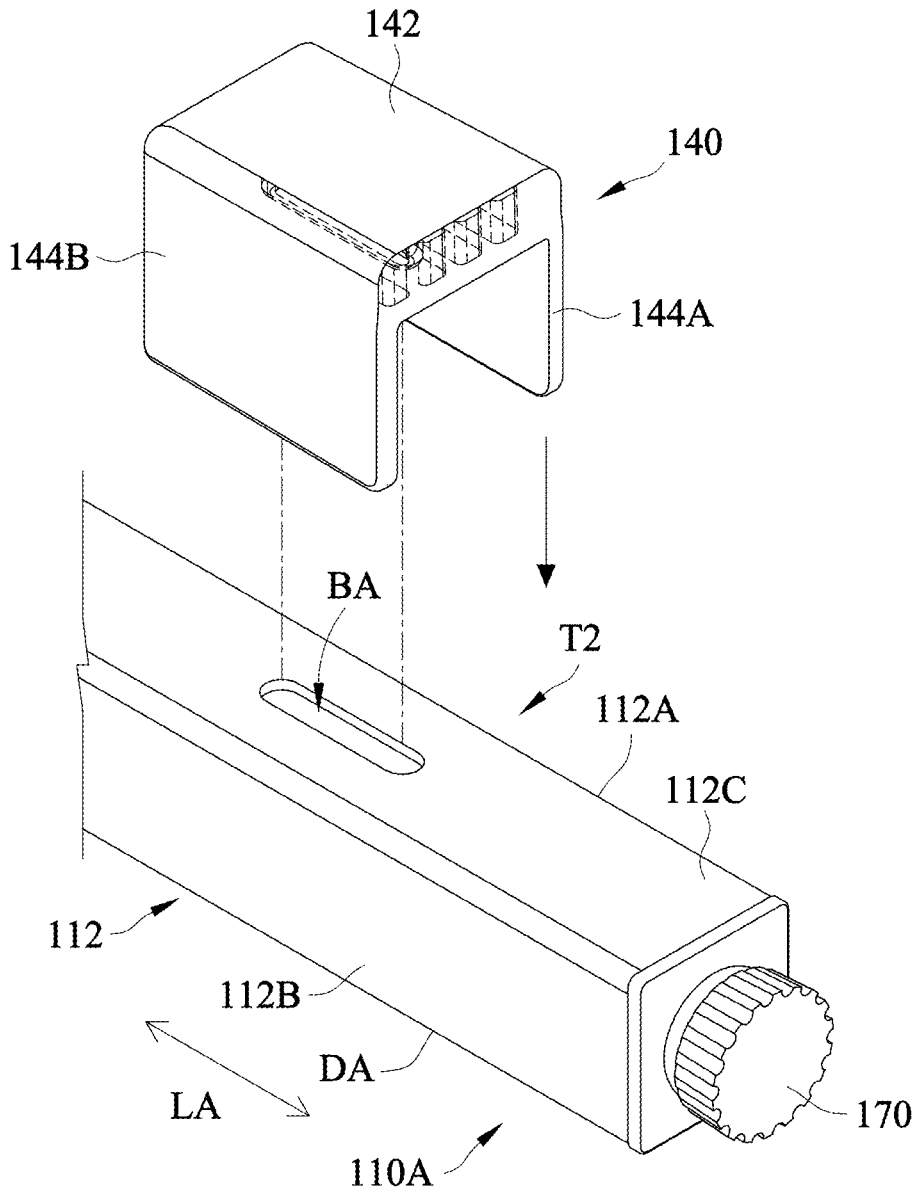
FIG. 4A is an exploded view of the lower end of the assembly fixture and the post component according to the present disclosure.
Figure 4B:
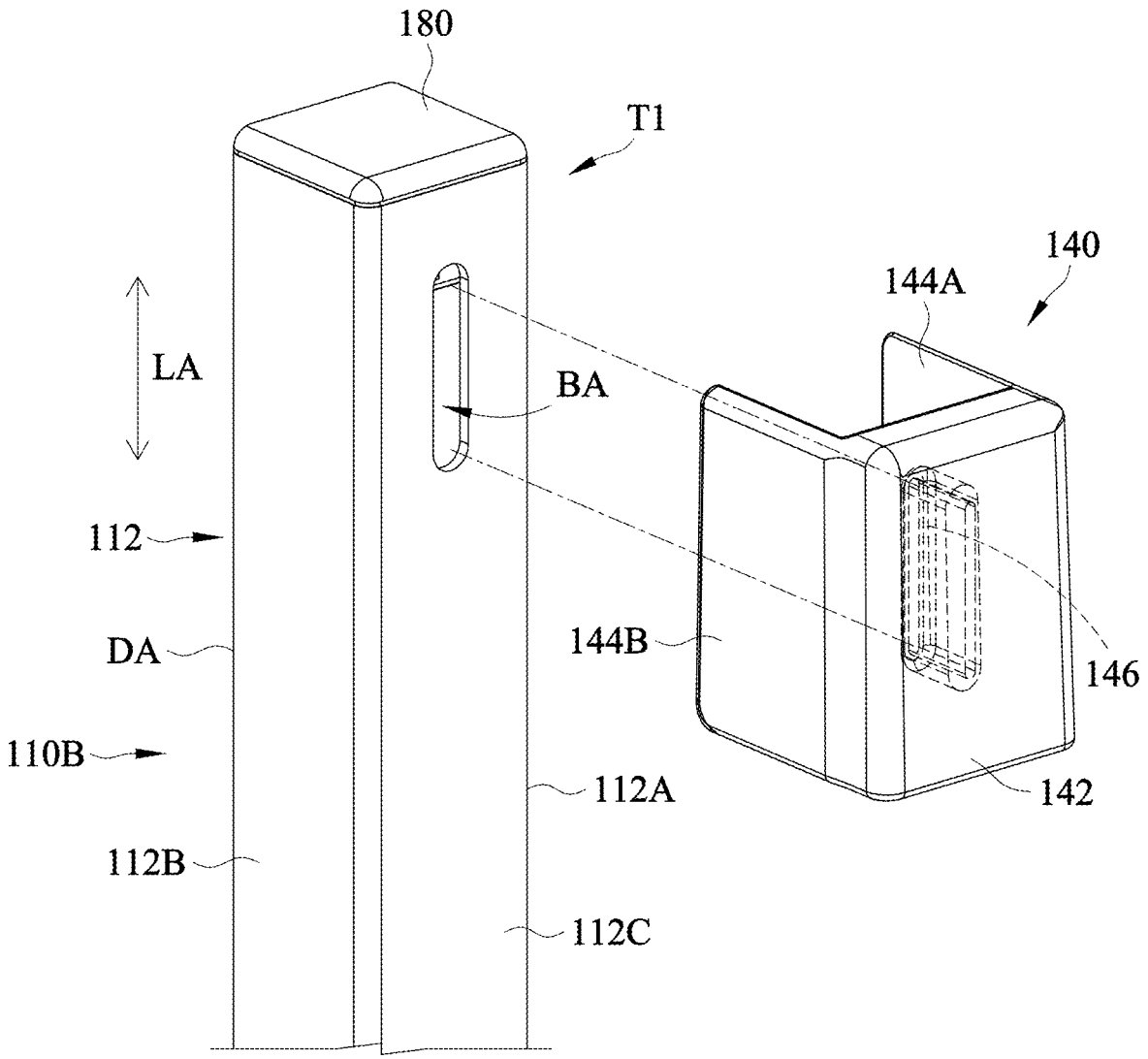
FIG. 4B is an exploded view of the upper end of the tube and the assembly fixture according to the present disclosure.
Figure 4C:
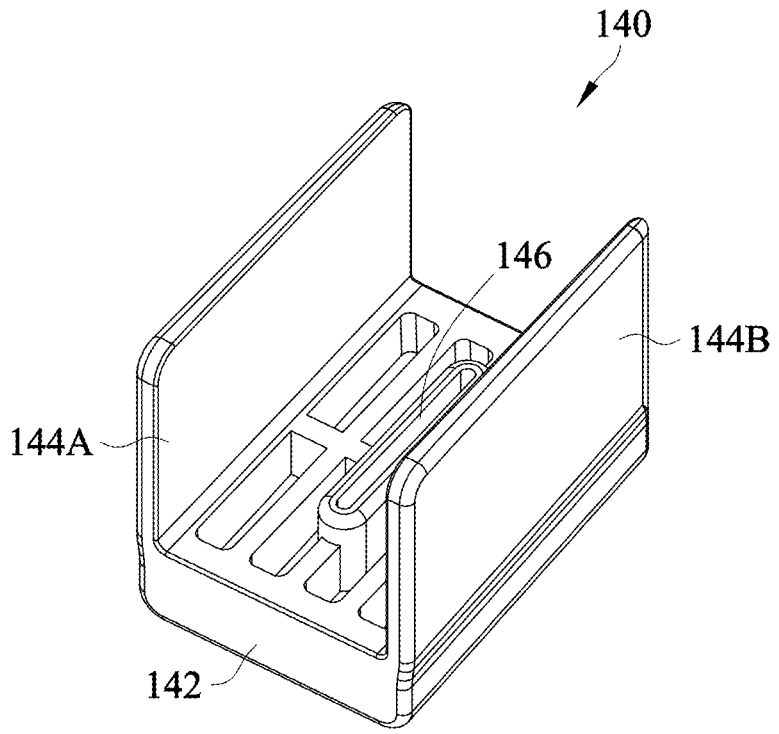
FIG. 4C is a three-dimensional schematic diagram of an assembly fixture according to the present disclosure.

FIG. 4A is an exploded view of the lower end of the assembly fixture and the post component according to the present disclosure. FIG. 4B is an exploded view of the upper end of the tube and the assembly fixture according to the present disclosure. FIG. 4C is a three-dimensional schematic diagram of an assembly fixture according to the present disclosure. Please refer to FIG. 1 and FIG. 4A to FIG. 4C. The adjustable lift combined type shelf 100 of the present disclosure further includes, in addition to the post component 110 and the storage layer 120, a plurality of assembly fixtures 140. A hole BA is respectively provided at the upper end T1 and the lower end T2 of each post component 110 for installing the assembly fixture 140.

Please refer to FIG. 1 and FIG. 4A again. An assembly fixture 140 is assembled at the upper end T1 and the lower end T2 of the post component 110 respectively. The assembly fixture 140 is assembled from the third plate 112C of the tube 112. The third plate 112C is provided with a plurality of holes BA. That is, the holes BA and the aforementioned fastening holes 116 are located at the positions on opposite sides (the third plate 112C and the assembly plate DA) of the tube 112. The assembling fixture 140 is provided with an assembly column 146. The assembly column 146 is installed in the hole BA, so as to assemble the assembly fixture 140 at the upper end T1 and the lower end T2 of the post component 110. The number and structural configuration of the assembly columns 146 can be matched with the number and structural configuration of the holes BA on the third plate 112C. As for the embodiment, the number of the assembly columns 146 is one, and the structural configuration of the assembly column 146 is a long cylinder. One corresponding hole BA is also provided, and the structural configuration of the hole BA can be matched with the long cylinder to form a long hole.

In one embodiment, the assembly fixture 140 is in a ㄇ-shaped configuration, which includes a bottom plate 142, a first side plate 144A, a second side plate 144B, and an assembly column 146. Two sides of the bottom plate 142 are respectively vertically connected to the first side plate 144A and the second side plate 144B, and the first side plate 144A and the second side plate 144B are opposite sides. The assembly column 146 is disposed on and protrudes from the inner surface of the bottom plate 142.

Take FIG. 4A as an example. The assembly fixture 140 is assembled from the third plate 112C of the tube 112. That is, if the assembly plate DA is defined as the front side position of the tube 112, the assembly fixture 140 will be installed at the rear side position of the tube 112. The first side plate 144A, the second side plate 144B, and the bottom plate 142 in the assembly fixture 140 correspond to the first plate 112A, the second plate 112B, and the third plate 112C in the tube 112 respectively. The position of the assembly column 146 corresponds to the hole BA located on the third plate 112C.

When the assembly fixture 140 moves toward the third plate 112C, the assembly column 146 is assembled in the hole BA. Accordingly, the first side plate 144A is attached to the surface of the first plate 112A, the second side plate 144B is attached to the surface of the second plate 112B, and the bottom plate 142 is attached to the surface of the third plate 112C, so as to assemble the assembly fixture 140 to the tube 112. The assembled state can refer to FIG. 7. Similarly, the structure and process of assembling the assembly fixture 140 in FIG. 4B to the third plate 112C of the tube 112 are the same as those in FIG. 4A, so that the assembly fixture 140 is arranged at the upper end T1 and the lower end T2 of the post component 110. Therefore, although a plurality of fastening holes 116 are arranged on the assembly plate DA, only the positions of two fastening holes 116 (i.e., located at the upper end T1 and the lower end T2 of the post component 110) will correspond to the assembly fixture 140.

Figure 5:
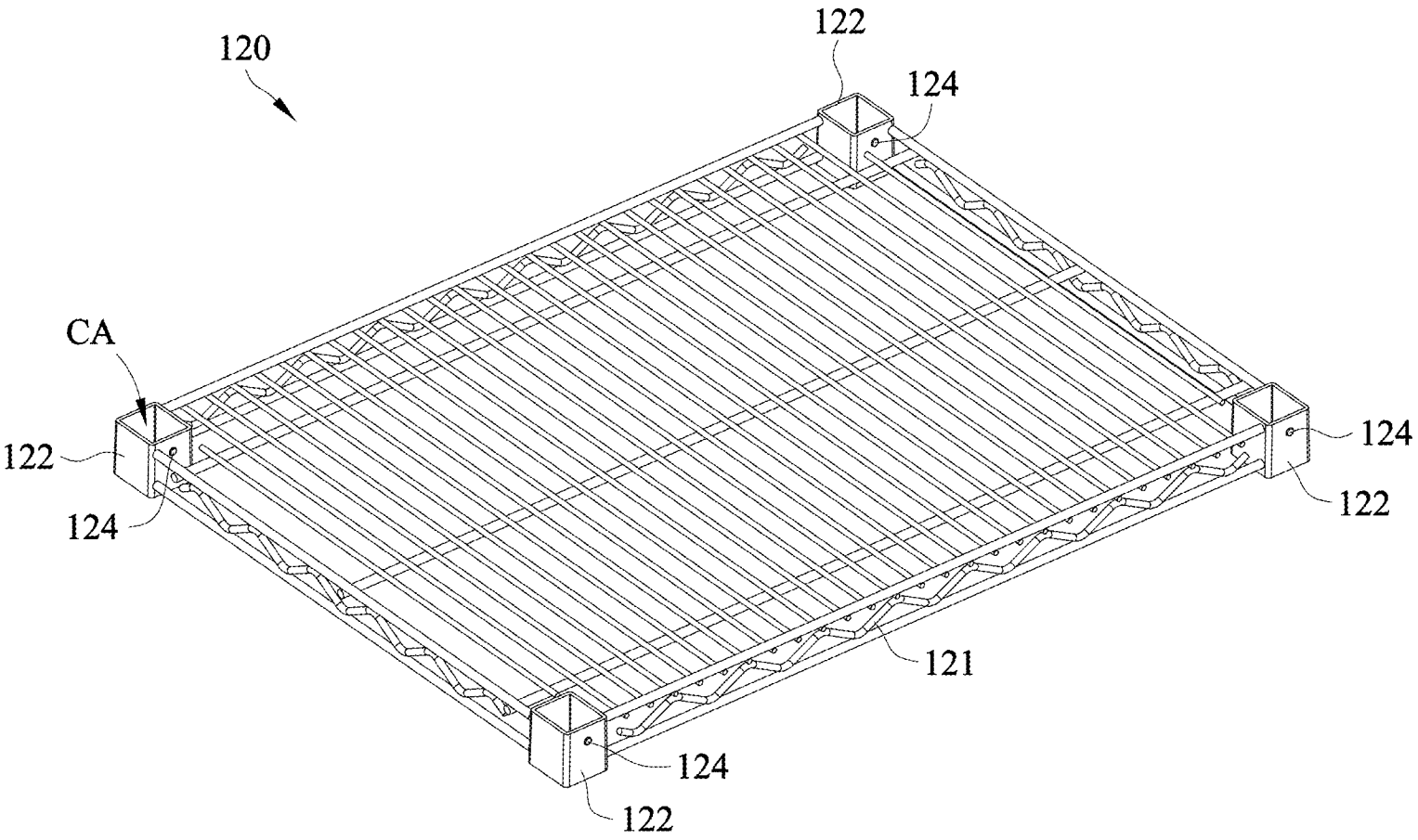
FIG. 5 is a three-dimensional schematic diagram of a storage layer according to the present disclosure.

FIG. 5 is a three-dimensional schematic diagram of a storage layer according to the present disclosure. Please refer to FIG. 1 and FIG. 5. The storage layer 120 of the present disclosure includes a movable shelf 121 and four sleeve components 122. The movable shelf 121 can be, for example, a mesh frame. The four first sleeve components 122 are respectively disposed at four corners of the movable shelf 121. The sleeve component 122 can be, for example, a square sleeve which is substantially square and has a hollow structure.

Figure 7:
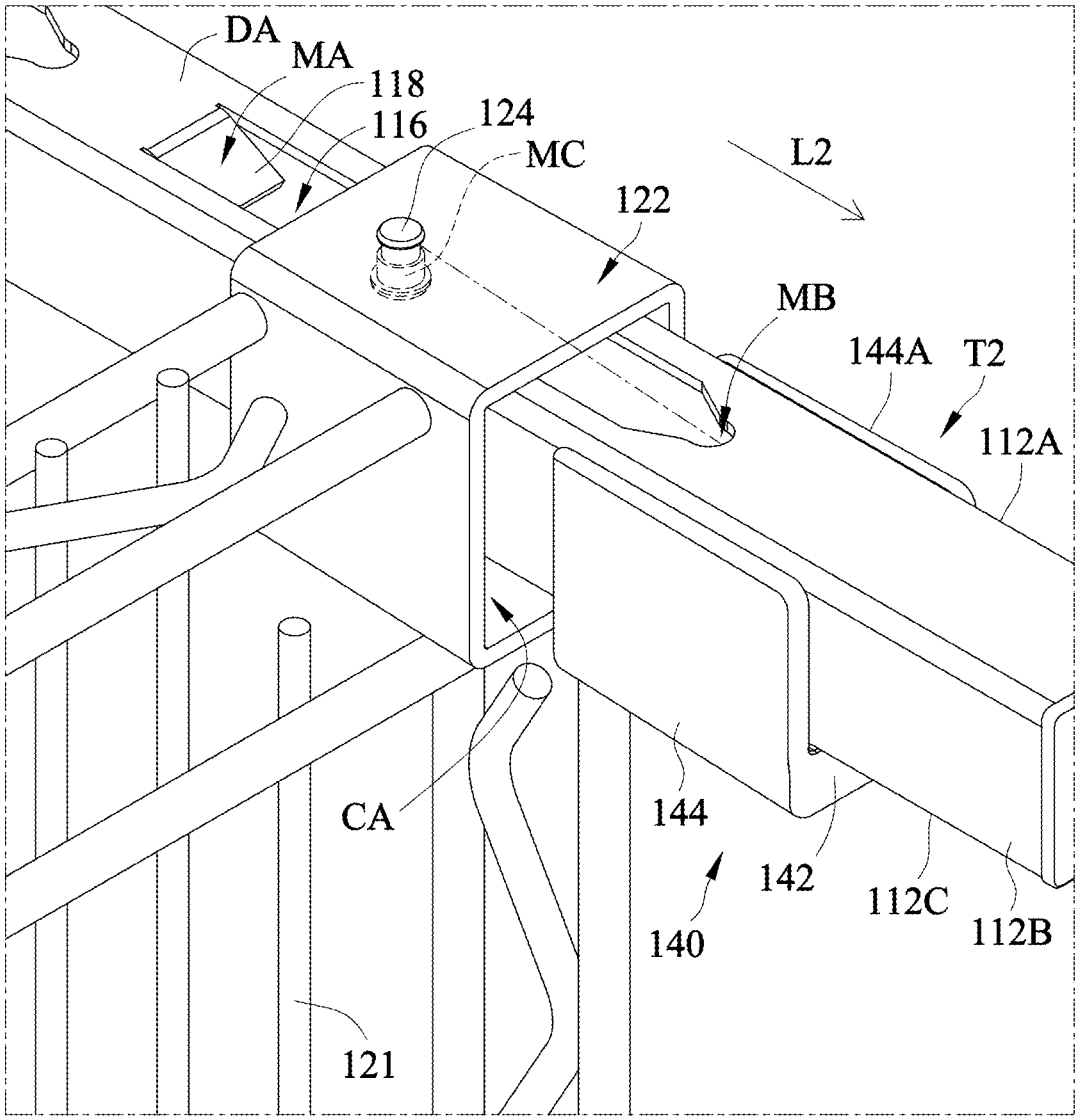
FIG. 7 is a partial three-dimensional enlarged schematic diagram of installing a storage layer to the fastening hole and the assembly fixture at the lower end of a post component according to the present disclosure.
Figure 8:
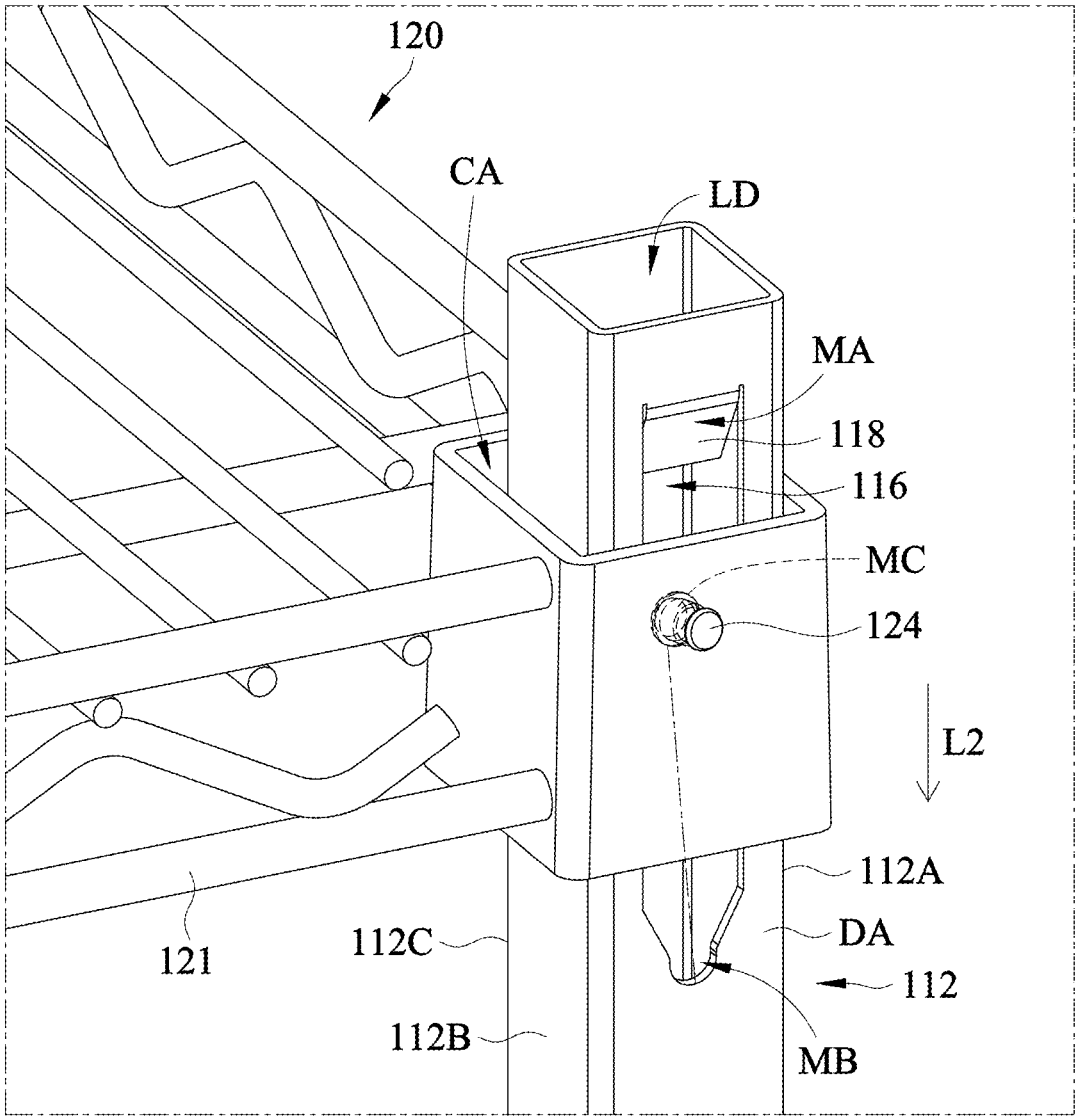
FIG. 8 is a partial enlarged perspective view of installing the storage layer in the fastening hole of the post component according to the present disclosure.

The storage layer 120 of the present disclosure includes a movable shelf 121, four sleeve components 122, and four assembly elements 124. The movable shelf 121 can be, for example, a mesh frame. The four first sleeve components 122 are respectively disposed at four corners of the movable shelf 121. The sleeve component 122 is, for example, a square sleeve which is substantially square in shape. Furthermore, the sleeve component 122 is a hollow structure and has an accommodating portion CA. Each sleeve component 122 is provided with an assembly element 124. A protruding cylinder MC is provided on one side of the assembly element 124 (as shown in FIG. 7 and FIG. 8). The protruding cylinder MC is located inside the accommodating portion CA in the sleeve component 122. In one embodiment, the sleeve component 122 can be a body of square sleeve having four plates connected to form a hollow square structure. The accommodating portion CA is the sleeve component 122 as the space inside the square sleeve, but is not limited by the present disclosure. The assembly component can be any other shape, or the structural configuration of the assembly component can be adjusted according to the structural type of the tube.

Figure 6:
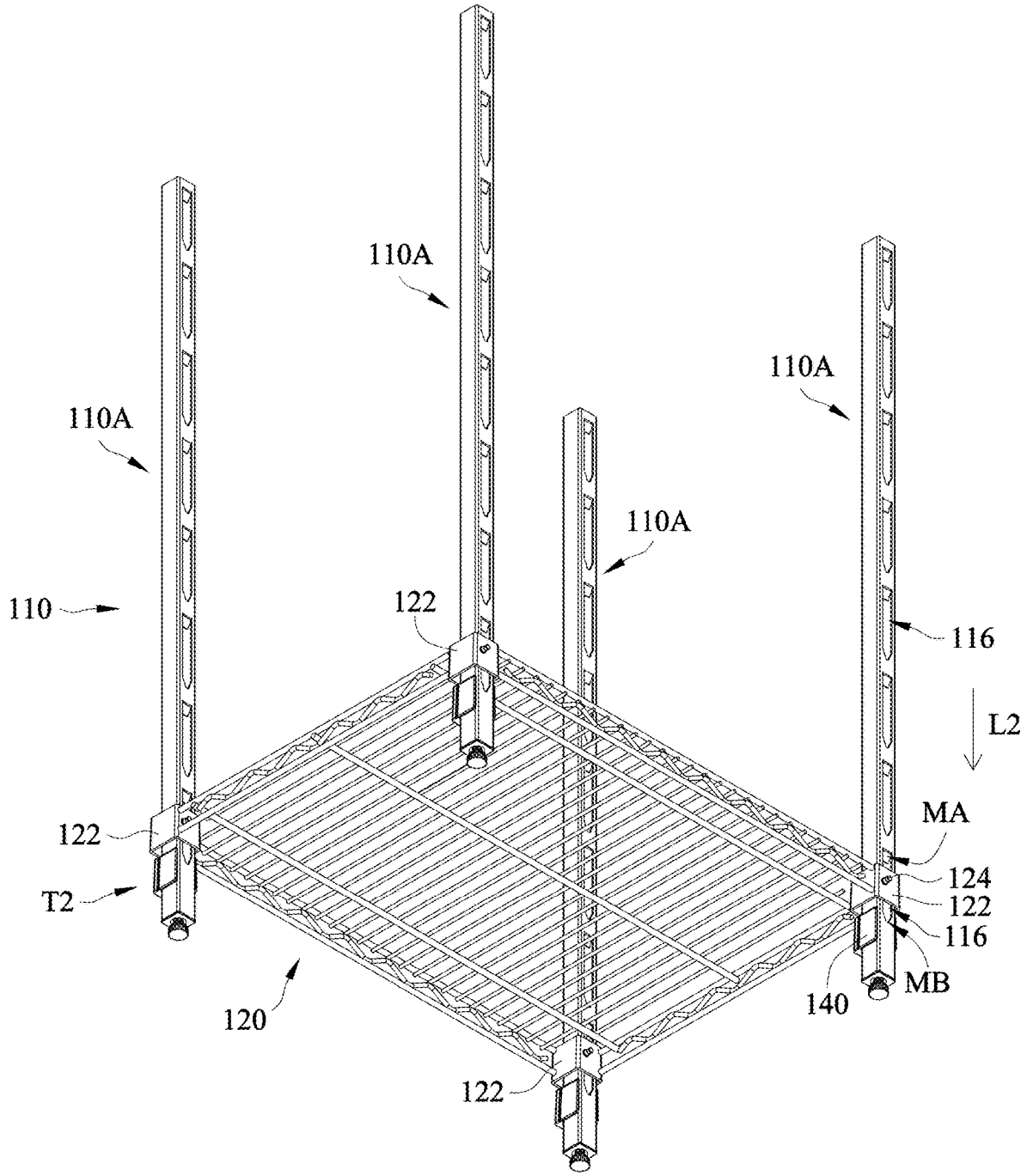
FIG. 6 is a three-dimensional schematic diagram of a process of installing a storage layer to the fastening hole and the assembly fixture at the lower end of a post component according to the present disclosure.

FIG. 6 is a three-dimensional schematic diagram of a process of installing a storage layer to the fastening hole and the assembly fixture at the lower end of a post component according to the present disclosure. FIG. 7 is a partial three-dimensional enlarged schematic diagram of installing a storage layer to the fastening hole and the assembly fixture at the lower end of a post component according to the present disclosure. FIG. 8 is a partial enlarged perspective view of installing the storage layer in the fastening hole of the post component according to the present disclosure. The upper end T1 and the lower end T2 of the post component 110 are respectively provided with the assembly fixture 140. Therefore, please refer to FIGS. 6 to 8 to illustrate the assembly process of the storage layer 120 of the present disclosure installed at the lower end T2 of the post component 110, and the respective combination structures of the sleeve component 122 with the fastening hole 116 and the assembly fixture 140. The process of installing the storage layer 120 at the upper end T1 of the post component 110 is similar to that of the lower end T2, so it will not be repeated.

The size of the sleeve component 122 of the present disclosure is larger than the size of the tube 112 of the post component 110, and the size of the protruding cylinder MC is smaller than the size of the opening end MA of the fastening hole 116. Accordingly, the protruding cylinder MC can move from the opening end MA of the fastening hole 116 to the closing end MB along the assembly direction L2. In addition, the size of the protruding cylinder MC is substantially consistent with the size of the closing end MB of the fastening hole 116, so that the protruding cylinder MC can be fixed at the closing end MB. The storage layer 120 moves along the assembly direction L2, and the assembly direction L2 is opposite to the stacking direction L1 as shown in FIG. 1. The square sleeve structure of the sleeve component 122 is sleeved onto the outer side of the tube 112, and the protruding cylinder MC in the assembly element 124 faces and moves toward the direction of the fastening hole 116 (i.e., identical to the assembly direction L2). The storage layer 120 continues to move along the assembly direction L2, so that the protruding cylinder MC in the assembly element 124 moves along the opening end MA of the fastening hole 116 until the protruding cylinder MC snaps into the closing end MB of the fastening hole 116, thereby fixing the storage layer 120 at the position of the lower end T2 of the tube 112 in the post component 110.

In one embodiment, while the aforementioned storage layer 120 continues to move along the assembly direction L2, since the upper end T1 and the lower end T2 of the post component 110 are respectively provided with the assembly fixture 140, the protruding cylinder MC in the sleeve component 122 is fastened outside the fastening hole 116, and the sleeve component 122 is attached to the outer surface of the corresponding assembly fixture 140. The first side plate 144A, the second side plate 144B, and the bottom plate 142 in the assembly fixture 140 will be attached to the inner surface of the sleeve component 122, so that the assembly fixture 140 will be located in the accommodating portion CA in the sleeve component 122, so as to enhance the stability of the storage layer 120 disposed at the upper end T1 and the lower end T2 of the post component 110.

No assembly fixture 140 is provided between the upper end T1 and the lower end T2 in the post component 110 of the present disclosure. However, the assembly process of the combination structure of the storage layer 120 installed in the sleeve component 122 and the fastening hole 116 of the post component 110 in the aforementioned FIG. 7 is also similar to the assembly process of the combination structure of the storage layer 120 installed in the sleeve component 122 and the fastening hole 116 of the post component 110 in FIG. 8. After the storage layer 120 is assembled at the lower end T2 of the post component 110 by the sleeve component 122, the size of the sleeve component 122 of the present disclosure is larger than the size of the tube 112 of the post component 110, and another storage layer 120 is moved along the assembly direction L2 on the tube 112. In addition, the square sleeve structure of the sleeve component 122 is sleeved on the outside of the tube 112 to provide a movable space, which is the space formed between the sleeve component 122 and the tube 112. The protruding cylinder MC faces and moves toward the direction of the fastening hole 116 (i.e., identical to the assembly direction L2). The storage layer 120 continues to move along the assembly direction L2, so that the protruding cylinder MC in the assembly element 124 moves along the opening end MA of the fastening hole 116 until the protruding cylinder MC snaps into the closing end MB of the fastening hole 116, until the protruding cylinder MC snaps into the fastening hole 116, so as to fix the storage layer 120 to the tube 112 in the post component 110.

In addition, while the aforementioned storage layer 120 continues to move along the assembly direction L2, since the size of the fastening hole 116 along the assembly direction L2 is a tapered hole structure, the size of the opening end MA to the closing end MB in the fastening hole 116 gradually decreases. Accordingly, along the assembly direction L2, during the moving process of the protruding cylinder MC from the opening end MA to the closing end MB, the combination tightness degree of the protruding cylinder MC and the fastening hole 116 will gradually tighten, making it easier for the protruding cylinder MC to enter the fastening hole 116. As the protruding cylinder MC continues to move along the assembly direction L2, since the size of the fastening hole 116 gradually decreases, the protruding cylinder MC can be fastened inside the fastening hole 116, and the assembler can be informed that the assembly is completed.

Figure 9:
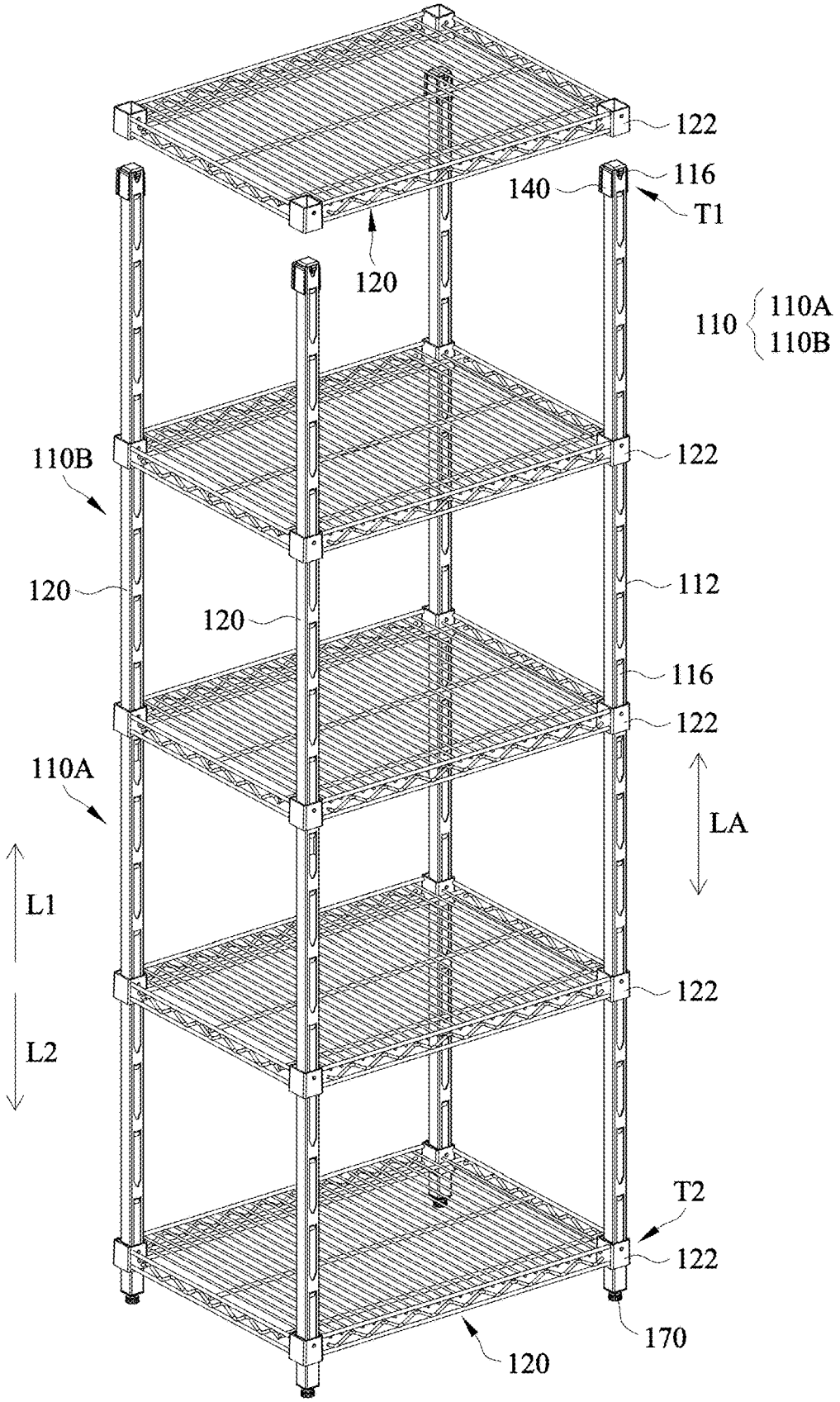
FIG. 9 is a three-dimensional schematic diagram of a process of installing a storage layer to the upper end and the assembly fixture of the post component according to the present disclosure.
Figure 10:
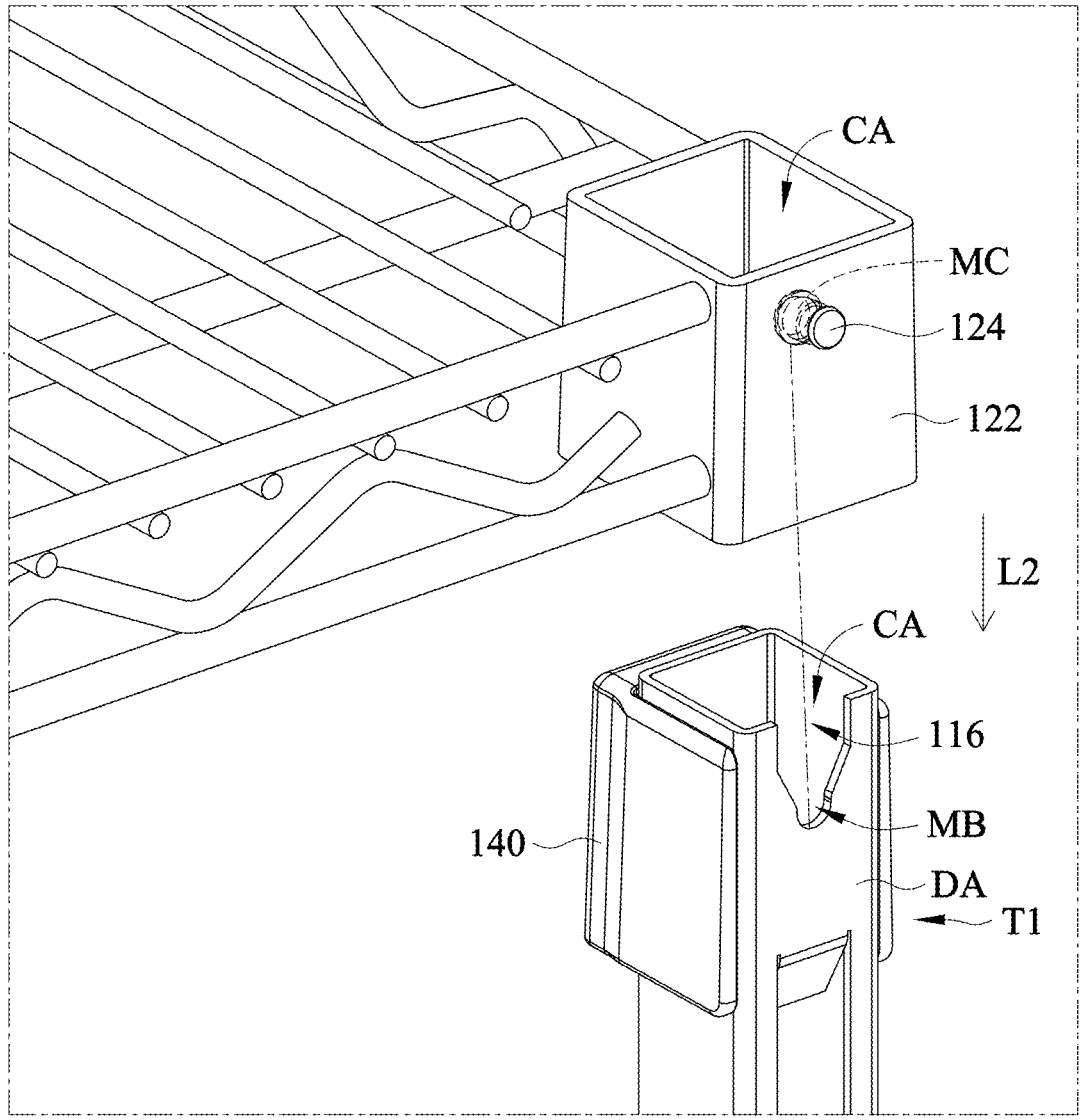
FIG. 10 is a partial three-dimensional schematic diagram of a process of installing a storage layer to the upper end and the assembly fixture of the post component according to the present disclosure.

FIG. 9 is a three-dimensional schematic diagram of a process of installing a storage layer to the upper end and the assembly fixture of the post component according to the present disclosure. FIG. 10 is a partial three-dimensional schematic diagram of a process of installing a storage layer to the upper end and the assembly fixture of the post component according to the present disclosure. Please refer to FIG. 1, FIG. 9 and FIG. 10. After assembling the three storage layers 120 above the lower end T2 of the post component 110 in sequence, a storage layer 120 is assembled to the upper end T1 of the post component 110. The assembly steps are the same as those in FIG. 8. It should be noted that, as shown in FIG. 10, the fastening hole 116 here is still a tapered hole structure, the fastening hole 116 is provided with an closing end MB without an inclined plate 118, and the protruding cylinder MC continues to move along the assembly direction L2. As the size of the fastening hole 116 gradually decreases, the protruding cylinder MC can be fastened inside the closing end MB of fastening hole 116.

Based on the foregoing, the size of the sleeve component 122 in the storage layer 120 of the present disclosure is larger than the size of the tube 112 of the post component 110. Accordingly, these storage layers 120 can be moved up and down relative to the post component 110 along the lifting direction LA. In addition, during the moving process along the assembly direction L2, the storage layer 120 can be assembled to the post component 110. The stability of the storage layer 120 assembled to the post component 110 can be improved by setting the assembly fixtures at the upper end T1 and the lower end T2 of the post component 110.

Furthermore, as shown in FIG. 7 and FIG. 8, when adjusting the storage layer 120 to move upward relative to the post component 110 along the stacking direction L1, the protruding cylinder MC in the assembly element 124 follows the inclined structure of the inclined plate 118 to facilitate the movement of the storage layer 120.

Figure 11:
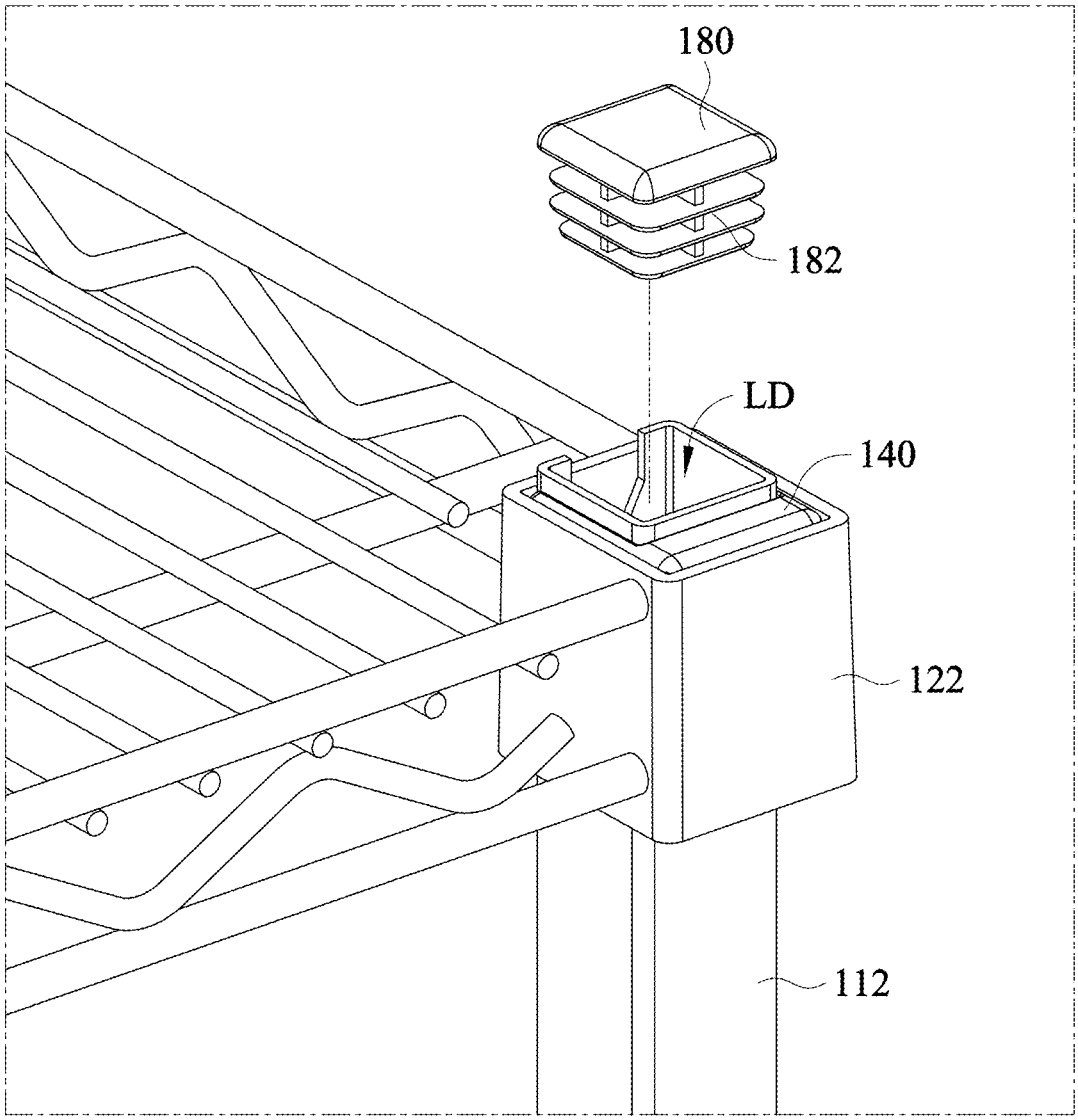
FIG. 11 is a partially enlarged exploded perspective view of the cover piece and the assembly components of the present disclosure.

FIG. 11 is a partially enlarged exploded perspective view of the cover piece and the assembly components of the present disclosure. Please refer to FIG. 1 and FIG. 11. In one embodiment, a cover piece 180 may be added on the post component 110 to cover the hollow portion LD above the post component 11, thereby increasing the aesthetics. The cover piece 180 can include a coupling structure 182. The structural configuration of the coupling structure 182 can be matched to the structural configuration of the hollow portion LD. Accordingly, the coupling structure 182 can be inserted into the hollow portion LD, so as to install the cover piece 180 on the post component 110.

The above-mentioned FIGS. 1 to 11 take the tube 112 of the post component 110 as an example of a square tube structure, but the present disclosure is not limited thereto. The structure of the post component of the present disclosure can also be applied to a circular tube structure. The following FIGS. 12 to 18 are used as examples for explanation.

Figure 12:
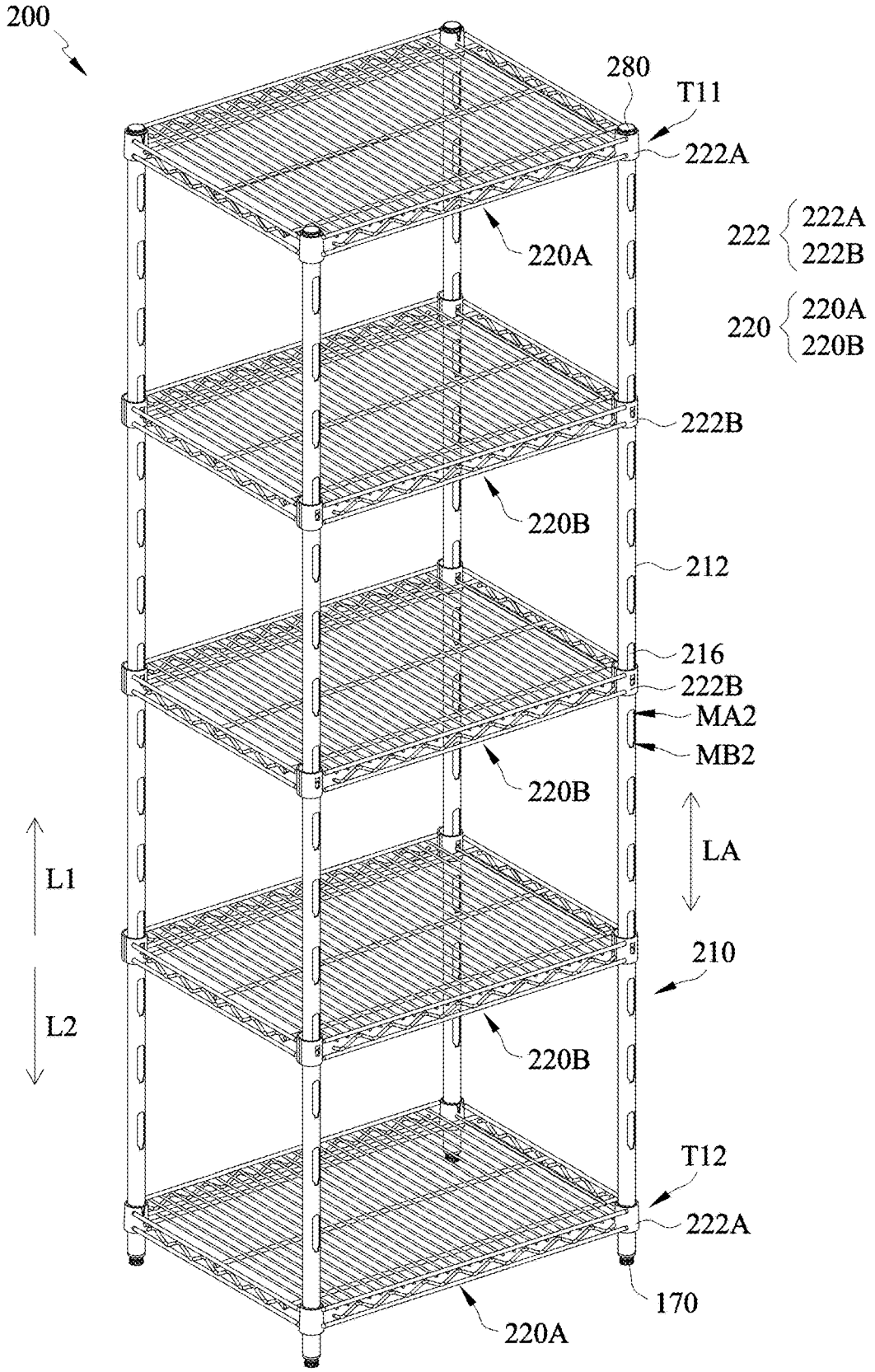
FIG. 12 is a three-dimensional schematic diagram of another embodiment of the adjustable lift combined type shelf according to the present disclosure.

FIG. 12 is a three-dimensional schematic diagram of another embodiment of the adjustable lift combined type shelf according to the present disclosure. Please refer to FIG. 12. The adjustable lift combined type shelf 200 of the present disclosure includes a plurality of post components 210 and five storage layers 220. Each storage layer 220 has sleeve components 222 at four corners. FIG. 12 has a total of four post components 210. The two post components 210 located in the front are separated by a distance, the two post components 210 located in the rear are also separated by a distance, and the two post components 210 in the front and rear are also separated by a distance. These post components are arranged in a rectangular shape or an arbitrary shape. The foot post 170 is disposed under the post component 210. The foot post 170 is used to increase the stability of the overall adjustable lift combined type shelf 100 as shown in FIG. 1. The post component 210 has an upper end T11 and a lower end T12 opposite to the upper end T11. The storage layer 220 can be divided into a first type of storage layer 220A and a second type of storage layer 220B. The sleeve component 222 can be divided into a first type of sleeve component 222A and a second type of sleeve component 222B. The first type of sleeve component 222A is arranged at the four corners of the first type of storage layer 220A, and the second type of sleeve component 222B is arranged at the four corners of the second type of storage layer 220B.

These five storage layers 220 are sequentially located between the post components 110 along the stacking direction L1. The positions of the upper end T11 and the lower end T12 of the post component 210 correspond to the four first type of sleeve components 222A connected to the first type of storage layers 220A. Three second type of storage layers and the second type of sleeve components 222B connected to the second type of storage layers are arranged between the two first type of storage layers 220A.

The storage layers 220 have a structural configuration that can move along the lifting direction LA, and can be assembled between the post components 210 through the sleeve components 222. Therefore, the storage layers 220 have a structural configuration that can move along the lifting direction LA, and the height position of the storage layer 120 can be adjusted according to actual conditions to improve the convenience of use. The number and types of the storage layers 220 can be adjusted according to actual needs, so that a variety of different combinations of the adjustable lift combined type shelfs 200 can be formed.

Figure 16:
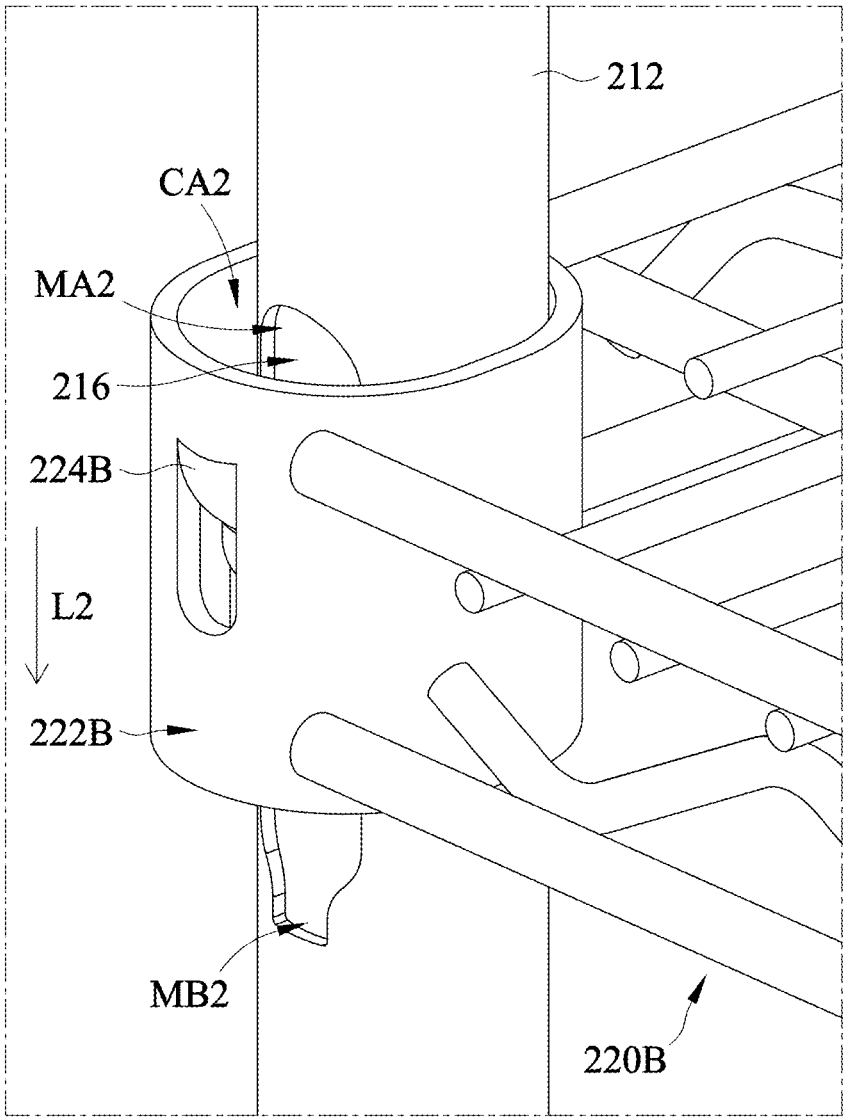
FIG. 16 is a partial enlarged perspective view of a process of installing the second type of storage layer into the fastening hole in the post component according to the present disclosure.
Figure 17:
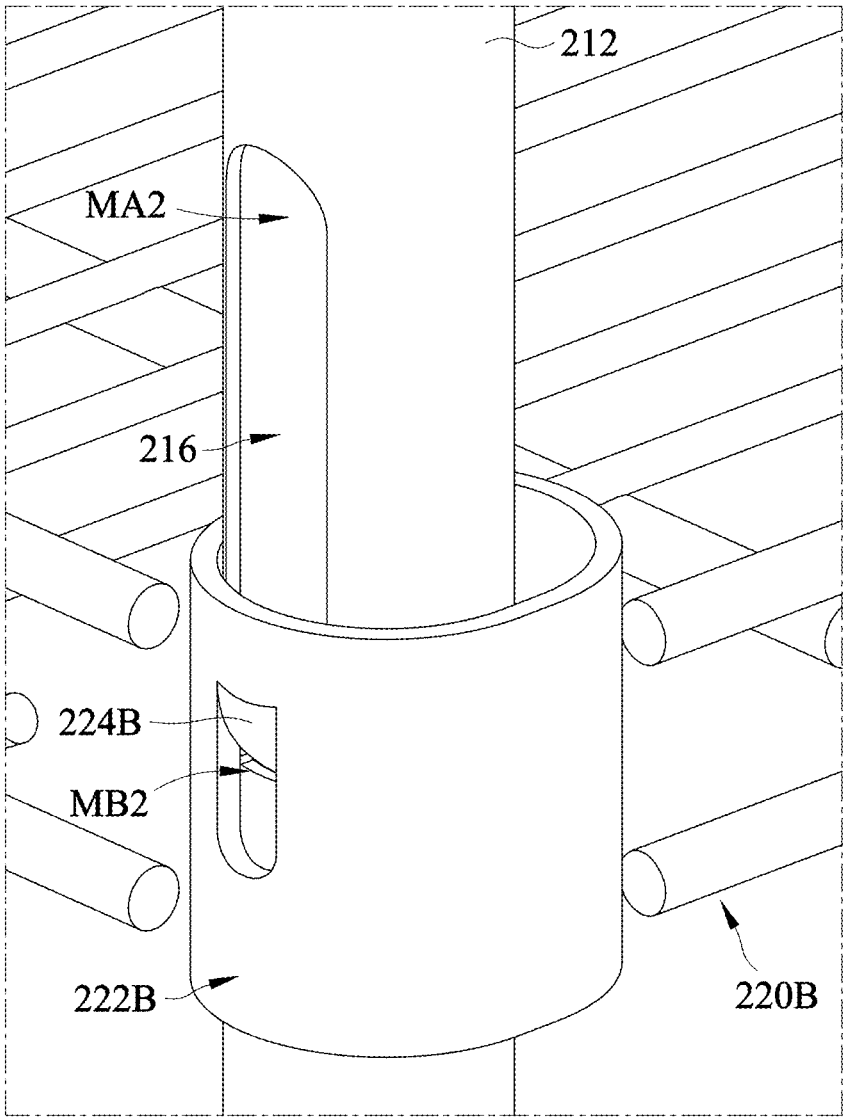
FIG. 17 is a partial three-dimensional enlarged schematic diagram of the second type of storage layer installed in the fastening hole of the post component according to the present disclosure.

The post component 210 of this embodiment includes a tube 212 and a plurality of fastening holes 216. The tube 212 may be a circular tube structure and a hollow tube. A cover piece 280 may be added above the post component 21. The cover piece 280 can be adjusted to match the shape and structure of the tube 212. The cover piece 280 is installed on the post component 210. These fastening holes 216 are respectively penetrated in the tube 212 at intervals. The fastening hole 216 are along the length direction of the tube 212. The length direction is parallel to an assembly direction L2 (the assembly direction L2 is opposite to the stacking direction L1 as shown in FIG. 12). The fastening hole 216 has an opening end MA2 and a closing end MB2 opposite to each other. The size of the opening end MA2 is larger than the size of the closing end MB2. In one embodiment, along the assembly direction L2, the size of the fastening hole 216 gradually decreases from the opening end MA2 to the closing end MB2. That is, the size of the fastening hole 216 along the assembly direction L2 is a tapered hole structure. In one embodiment, the cross section of the closing end MB2 is a rectangular structure with an opening, and the cross section of the opening end MA2 is a curved structure (as shown in FIG. 16 or FIG. 17).

Figure 13:
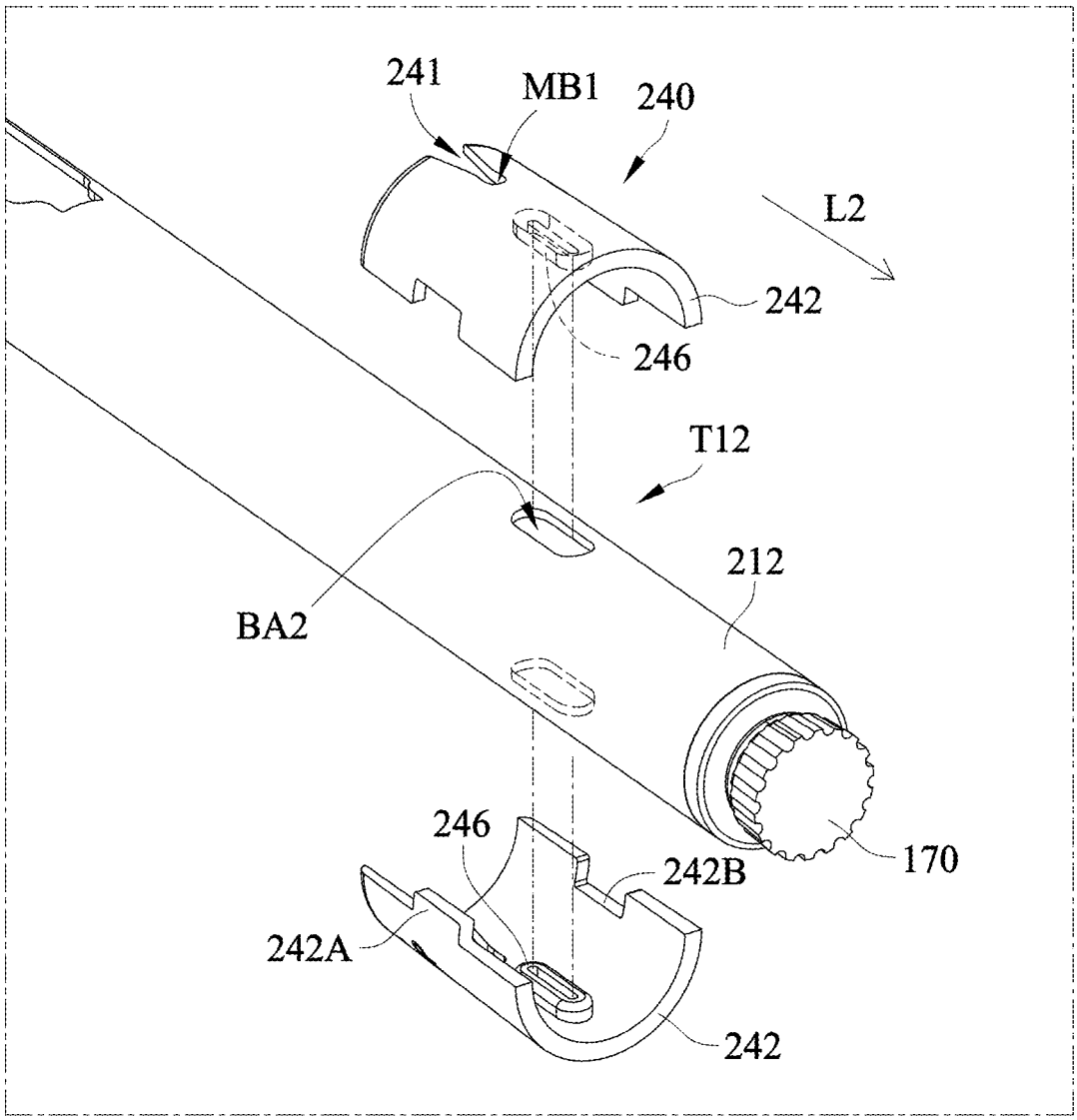
FIG. 13 is an exploded view of the lower end of the assembly fixture and the post component according to the present disclosure.

FIG. 13 is an exploded view of the lower end of the assembly fixture and the post component according to the present disclosure. The adjustable lift combined type shelf 200 of the present disclosure includes a plurality of assembly fixtures 240, in addition to the post component 210 and the storage layer 220. Two holes BA2 are respectively disposed at the upper end T11 and the lower end T12 of each post component 210 for installing the assembly fixture 240. In addition, the assembly fixture 240 of this embodiment can be provided with another type of fastening hole 241. That is, two holes BA2 are respectively provided at the upper end T11 and the lower end T12 of each post component 210, and a fastening hole 216 is provided between the positions of the upper end T11 and the lower end T12. The fastening hole 241 is the same as the fastening hole 216. Along the assembly direction L2, the fastening hole 241 gradually decreases in size, and thus the fastening hole 241 has a closing end MB1.

The assembly fixture 240 is disposed on the outer surface of the tube 212 in the upper end T1 and the lower end T2 of the post component 110. The assembly fixture 240 is provided with two assembly columns 246. The two assembly columns 246 are installed in the corresponding holes BA2 to assemble the assembly fixture 240 to the tube 212. In addition, since the tube 212 of this embodiment is a circular tube structure, an embodiment of the assembly fixture 240 may include two semicircular components 242, and an assembly column 246 is respectively provided on the inner surface of the two semicircular components 242. The structural configuration of the assembly column 246 is a long cylinder, and the structural configuration of the hole BA2 can be matched with the aforementioned long cylinder to form a long hole.

In one embodiment, the two semicircular components 242 are assembled on the outer surface of the tube 212 by interlocking. For example, a protrusion 242A and a recess 242B are provided on both sides of the semicircular component 242. The protrusion 242A of one semicircular component 242 corresponds to and engages with the recess 242B of the other semicircular component 242, and the recess 242B of one semicircular component 242 corresponds to and engages with the protrusion 242A of the other semicircular component 242. With this configuration, the assembly column 246 of one semicircular component 242 is installed in the corresponding hole BA2, the assembly column 246 of the other semicircular component 242 is installed in the corresponding hole BA2, and the protrusion 242A and the recess 242B of one semicircular component 242 are respectively assembled in the corresponding recess 242B and the protrusion 242A of the other semicircular component 242, so that the two semicircular components 242 are assembled on the tube 212. The above description is taken as an example at the lower end T12 of the post component 210. Similarly, the assembly fixture 240 at the upper end T11 of the post component 210 is provided on the tube 212 of the post component 110, and the assembly fixture 240 at the lower end T12 of the post component 210 is provided on the tube 212 of the post component 110, and will not be repeated.

Figure 14:
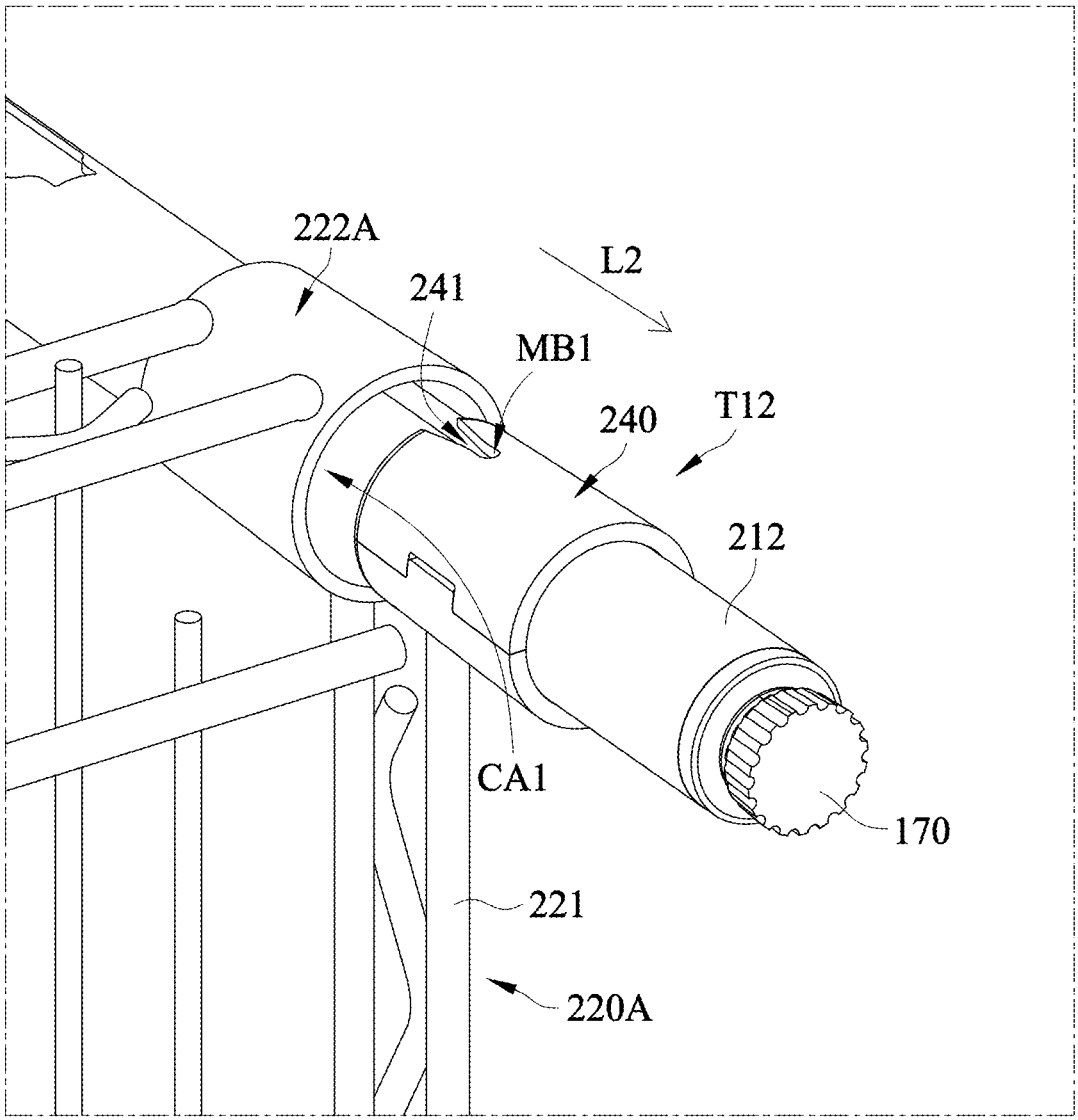
FIG. 14 is a partial three-dimensional enlarged schematic diagram of a process of installing the first type of storage layer to the fastening hole and the assembly fixture at the lower end of the post component according to the present disclosure.
Figure 15:
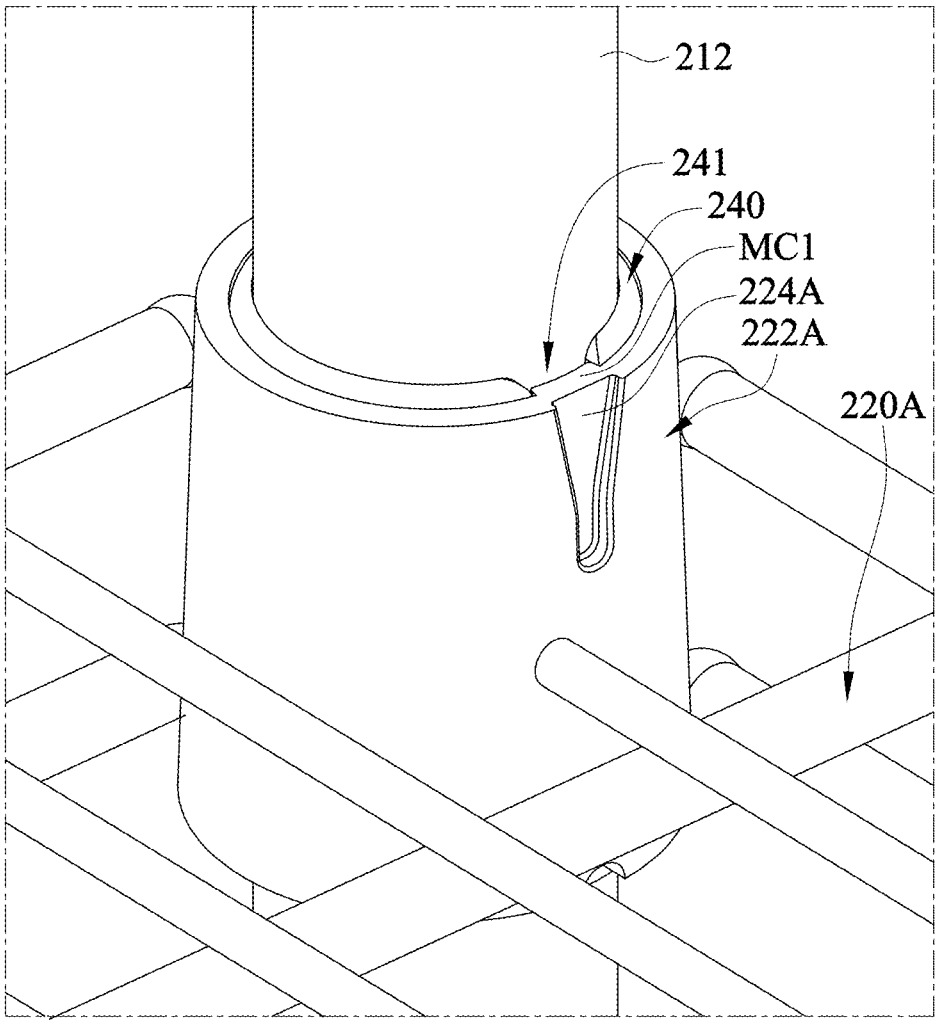
FIG. 15 is a partial enlarged perspective view of the first type of storage layer installed in the fastening hole in the post component according to the present disclosure.

FIG. 14 is a partial three-dimensional enlarged schematic diagram of a process of installing the first type of storage layer to the fastening hole and the assembly fixture at the lower end of the post component according to the present disclosure. FIG. 15 is a partial three-dimensional enlarged schematic diagram of the first type of storage layer installed in the fastening hole of the post component according to the present disclosure. Please refer to FIG. 14 to FIG. 15 to illustrate the assembly process of the first type of storage layer 220A in the storage layer s 220 of the present disclosure installed in the lower end T12 of the post component 210, and the combination structure of the first type of sleeve component 222A in the sleeve components 222 and the fastening hole 241 of the assembly fixture 240. The process of installing the first type of storage layer 220A in the upper end T11 of the post component 210 is similar to that of the lower end T12, so it will not be repeated.

The first type of storage layer 220A in the storage layers 220 includes a movable shelf 221 and four first type of sleeve components 222A. The four first type of sleeve components 222A are respectively disposed at four corners of the movable shelf 221. The first type of sleeve component 222A is a circular sleeve, which is roughly circular. The first type of sleeve component 222A is a hollow structure and has an accommodating portion CA1. Each first type of sleeve component 222A is provided with an assembly element 224A, and a protruding cylinder MC1 is provided on one side of the assembly element 224A (as shown in FIG. 15). The protruding cylinder MC1 is a recessed structure recessed in the outer surface of the sleeve component 222, and the protruding cylinder MC1 is located inside the first type of sleeve component 222A.

The size of the first type of sleeve component 222A of the present disclosure is larger than the size of the tube 212 of the post component 210. The first type of storage layer 220A moves along the assembly direction L2, which is opposite to the stacking direction L1 as shown in FIG. 12. The circular sleeve structure of the first type of sleeve component 222A is sleeved on the outer side of the tube 212, and the protruding cylinder MC1 in the assembly element 224A faces and moves toward the direction of the fastening hole 241 (i.e., identical to the assembly direction L2). The first type of storage layer 220A continues to move along the assembly direction L2 until the protruding cylinder MC1 is engaged with the closing end MB1 of the fastening hole 241, so as to fix the first type of storage layer 220A at the position of the lower end T12 of the tube 212 in the post component 110.

Based on the foregoing, the size of the first type of sleeve component 222A in the first type of storage layer 220A of the present disclosure is larger than the size of the tube 212 of the post component 210, so the first type of storage layer 220A can be moved up and down relative to the post component 210 along the lifting direction LA. During the moving process along the assembly direction L2, the first type of storage layer 220A can be assembled to the post component 210, and the assembly fixture 240 can be disposed at the upper end T1 and the lower end T2 of the post component 210 to enhance the stability of the storage layer 220 assembled to the post component 210.

FIG. 16 is a partial three-dimensional enlarged schematic diagram of a process of installing the second type of storage layer into the fastening hole in the post components according to the present disclosure. FIG. 17 is a partial three-dimensional enlarged schematic diagram of a process of installing the second type of storage layer into the fastening hole in the post component according to the present disclosure. Please refer to FIGS. 16 and 17. In this embodiment, a second type of sleeve component 222B is arranged at the four corners of the second type of storage layer 220B. The second type of sleeve component 222B is a circular sleeve which is roughly circular. The second type of sleeve component 222B is a hollow structure and has an accommodating portion CA2. Each of the second type sleeve components 222B is provided with an assembly element 224B. The assembly element 224B is a protruding cylinder extending toward the accommodating portion CA2. The protruding cylinder is located inside the first type or second type of sleeve component 222B.

The size of the second type of sleeve component 222B of the present disclosure is larger than the size of the tube 212 of the post component 210. The second type of storage layer 220B moves along the assembly direction L2, and the assembly direction L2 is opposite to the stacking direction L1 as shown in FIG. 12. The circular sleeve structure of the second type of sleeve component 222B is sleeved on the outer side of the tube 212. The assembly element 224B faces and moves toward the direction of the fastening hole 216 (i.e., identical to the assembly direction L2). During the moving process of the assembly element 224B from the opening end MA2 to the closing end MB2, the combination tightness degree of the assembly element 224B and the fastening hole 216 will gradually tighten, making it easier for the assembly element 224B to enter the fastening hole 216. As the assembly element 224B continues to move along the assembly direction L2, the size of the fastening hole 216 gradually becomes smaller, so that the assembly element 224B can be fastened in the fastening hole 216. The assembler can be informed that the assembly is completed, so as to fix the second type of storage layer 220B to the tube 212 in the post component 210.

Figure 18:
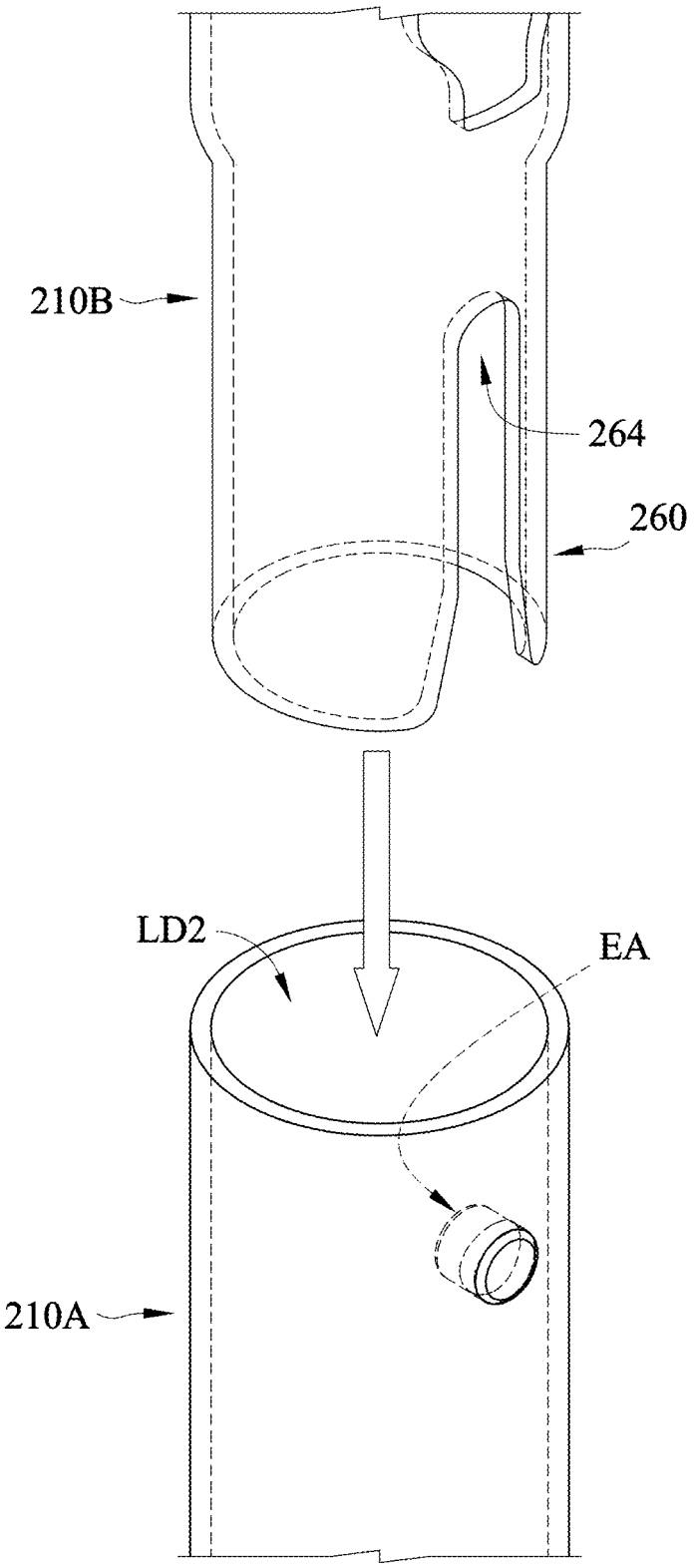
FIG. 18 is a three-dimensional schematic diagram of the assembly process of the first type of post component and the second type of post component of the present disclosure.

In addition, the post component 210 can be assembled to a predetermined length by utilizing the assembly methods shown in FIG. 2A and FIG. 2B. In one embodiment, FIG. 18 is a three-dimensional schematic diagram of the assembly process of the first type of post component and the second type of post component of the present disclosure. Please refer to FIG. 18. One end of the second type of post component 210B is connected to a connecting piece 260. The connecting piece 260 is provided with a recess 264. A protruding fixture EA is provided in the hollow portion LD2 of the first type of post component 210A. As such, the recess 264 is engaged with the protruding fixture EA, so that the connecting piece 260 is inserted into the hollow portion LD2, so as to assemble the first type of post component 210A and the second type of post component 210B together.

Based on the foregoing, in the adjustable lift combined type shelf of the present disclosure, the assembly structure is simple and relatively stable. In addition, the storage layer can move along the lifting direction on the post component, thereby improving the overall convenience of use.

In addition, since the size of the fastening hole along the assembly direction is a tapered hole structure, the combination tightness degree of the protruding cylinder and the fastening hole will gradually shrink during the moving process of the protruding cylinder along the assembly direction, making it easier for the protruding cylinder to enter the fastening hole. However, as the protruding cylinder continues to move along the assembly direction, the size of the fastening hole gradually becomes smaller, so that the protruding cylinder can be fastened in the fastening hole, and the assembler can be informed that the assembly is completed.

In addition, the assembly fixtures are respectively arranged at the upper end and lower end of the post component. Accordingly, the protruding cylinder in the sleeve component is fastened outside the fastening hole, and the assembly fixtures are located in the accommodating portion inside the sleeve component, so as to enhance the stability of the storage layer arranged on the post component.

In addition, the size of the assembly component in the storage layer of the present disclosure is larger than the size of the tube of the post component, and thus these storage layers can be moved up and down relative to the post component along the lifting direction. Furthermore, during the moving process along the assembly direction, the storage layers can be assembled to the post component, and the assembly fixtures can be assembled at the upper end and lower end of the post component to improve the stability of the storage layers assembled to the post component.

Although the disclosure has been disclosed in the form of embodiments, it is not intended to limit the present disclosure. Anyone with general knowledge in the field of technology may make some changes and modifications without departing from the spirit and scope of the present disclosure, and therefore the scope of protection of the disclosure shall be subject to the scope of the patent application attached hereto.

What is claimed is:

1. An adjustable lift combined type shelf, comprising:

a plurality of post components each comprising a tube and a plurality of holes respectively, wherein each of the plurality of holes has a first length; and wherein each of the post components has an upper end and a lower end opposite to the upper end, and at least one of the holes is disposed at the upper end and at least one of the holes is disposed at the lower end of each of the post components;

a plurality of assembly fixtures each having at least one assembly column, wherein each of the assembly columns is installed in a corresponding hole from the plurality of holes to assemble the assembly fixtures at the upper end and the lower end of each of the post components respectively;

a plurality of fastening holes each having a closing end respectively, wherein each of the plurality of fastening holes has a second length that is longer than the first length; and a plurality of storage layers each comprising a movable shelf, four sleeve components, and four assembly elements respectively; wherein the four sleeve components are respectively arranged at four corners of each movable shelf; each of the sleeve components is provided with a corresponding assembly element from the four assembly elements; a protruding cylinder is arranged on one side of each of the assembly elements, each of the protruding cylinders is located inside a corresponding sleeve component from the four sleeve components, a size of each of the four sleeve assemblies is larger than a size of the tubes, the storage layers are configured to move along the second length of respective fastening holes in an assembly direction to adjust the height of each movable shelf; each of the protruding cylinders is respectively engaged within a corresponding fastening hole from the plurality of fastening holes to assemble the storage layers between the post components; the four sleeve components in the storage layers that correspond to the upper end and the lower end of each of the post components respectively are attached to an outer surface of a corresponding assembly fixture from the plurality of assembly fixtures.

2. The adjustable lift combined type shelf according to claim 1, wherein along the assembly direction, a shape of each fastening hole is a tapered hole structure.

3. The adjustable lift combined type shelf according to claim 1, wherein the fastening holes are respectively penetrated on the tube at intervals, each of the fastening holes has an opening end and the closing end opposite to each other, a size of each of the opening end is larger than a size of the corresponding closing end, and a size of each of the protruding cylinders is smaller than a size of the opening end of the corresponding fastening hole.

4. The adjustable lift combined type shelf according to claim 3, wherein a cross section of each of the closing ends is a curved structure, and a cross section of each of the opening ends is a rectangular structure with an opening.

5. The adjustable lift combined type shelf according to claim 3, wherein a cross section of each of the opening ends is a curved structure, and a cross section of each of the closing ends is a rectangular structure with an opening.

6. The adjustable lift combined type shelf according to claim 3, wherein each of the sleeve components is a square sleeve, each of the tubes is a square tube structure respectively, each of the tubes comprises a first plate, a second plate, a third plate, and an assembly plate, each of the first plates, the corresponding second plates, the corresponding third plates and the corresponding assembly plates are connected to form a square tube three-dimensional structure, the first plate and the corresponding second plate are on opposite sides, the assembly plate and the corresponding third plate are on opposite sides, the fastening holes are penetrated at different positions of the assembly plate, and two of the holes are penetrated respectively in the third plate.

7. The adjustable lift combined type shelf according to claim 6, wherein each of the assembly fixtures comprises a bottom plate, a first side plate, a second side plate, and one of the assembly columns, two sides of each of the bottom plates are respectively vertically connected to the corresponding first side plate and the second side plate, each of the first side plate and the corresponding second side plate are opposite sides, the assembly column is arranged and protrudes from an inner surface of the corresponding bottom plate, each of the first side plates is attached to the corresponding first plate, each of the second side plates is attached to the corresponding second plate, and each of the bottom plates is attached to the corresponding third plate.

8. The adjustable lift combined type shelf according to claim 6, wherein the assembly plate of each of the tubes is provided with a plurality of inclined plates, each of the inclined plates is connected to the opening end of the corresponding fastening hole.

9. The adjustable lift combined type shelf according to claim 1, wherein each of the tubes is a circular tube structure respectively, each of the sleeve components is a circular sleeve, and along the assembly direction, a shape of each fastening hole is a tapered hole structure, and one of the fastening holes is arranged at each corresponding assembly fixture.

10. The adjustable lift combined type shelf according to claim 9, wherein each of the sleeve components comprises two semicircular components that are engaged with each other.

* * * * *